US010987537B2

(12) United States Patent
Chuang

(10) Patent No.: US 10,987,537 B2
(45) Date of Patent: Apr. 27, 2021

(54) TWO-WAY RECIPROCATING STRUCTURE

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 37 days.

(21) Appl. No.: 16/406,002

(22) Filed: May 7, 2019

(65) Prior Publication Data

US 2020/0061408 A1 Feb. 27, 2020

(30) Foreign Application Priority Data

Aug. 24, 2018 (CN) ..... 201821371598.5

(51) Int. Cl.

| | |
|---|---|
| ***A63B 21/00*** | (2006.01) |
| ***A63B 21/04*** | (2006.01) |
| ***A63B 21/045*** | (2006.01) |
| ***A63B 21/22*** | (2006.01) |
| ***A63B 21/16*** | (2006.01) |

(52) U.S. Cl.

CPC ..... *A63B 21/151* (2013.01); *A63B 21/00043* (2013.01); *A63B 21/04* (2013.01);

(Continued)

(58) Field of Classification Search

CPC ..... A63B 21/0004; A63B 21/00043; A63B 21/00058; A63B 21/00069; A63B 21/00076; A63B 21/00178; A63B 21/00181; A63B 21/00185; A63B 21/002; A63B 21/0023; A63B 21/012; A63B 21/0125; A63B 21/015; A63B 21/018; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/0615; A63B 21/0616; A63B 21/0617; A63B 21/068; A63B 21/15; A63B 21/151; A63B 21/153;

(Continued)

(56) References Cited

U.S. PATENT DOCUMENTS 5,226,867 A * 7/1993 Beal ..... A63B 21/153 482/120
5,284,464 A * 2/1994 Lee, III ..... A63B 69/36213 482/121

(Continued)

*Primary Examiner* — Gary D Urbiel Goldner
(74) *Attorney, Agent, or Firm* — CKC & Partners Co., LLC

(57) ABSTRACT

A two-way reciprocating structure includes a body, a rotational axis assembly, a flexible element and a reciprocating member. The rotational axis assembly is disposed on the body. The flexible element has a first flexible end and a second flexible end, the first flexible end is connected to the rotational axis assembly. The rotational axis assembly is rotated by a force along a rotating direction to wind the flexible element around the rotational axis assembly, and the rotating direction is a clockwise direction or a counterclockwise direction. The reciprocating member has a first reciprocating end and a second reciprocating end. The first reciprocating end is disposed on the body, and the second reciprocating end is connected to the second flexible end and is simultaneously displaced with the second flexible end, wherein the rotational axis assembly is restored via a restoring fore relative to the force provided by the reciprocating member.

17 Claims, 20 Drawing Sheets

(52) U.S. Cl.
CPC ..... *A63B 21/045* (2013.01); *A63B 21/22* (2013.01); *A63B 21/16* (2013.01)

(58) Field of Classification Search
CPC ..... A63B 21/154; A63B 21/159; A63B 21/16; A63B 21/22; A63B 21/4027; A63B 21/4029; A63B 21/4031; A63B 21/4033; A63B 21/4039; A63B 21/4045; A63B 21/4047; A63B 21/4049; A63B 22/0046; A63B 23/02; A63B 23/0205; A63B 23/0211; A63B 23/0233; A63B 71/0054; A63B 2071/0063; A63B 2071/0072; A63B 2208/0214; A63B 2208/0219; A63B 2208/0228; A63B 2208/0233; A63B 2225/09; A63B 2225/093
See application file for complete search history.

(56) References Cited

U.S. PATENT DOCUMENTS 5,697,869 A * 12/1997 Ehrenfried ..... A63B 21/0058 482/129
5,738,611 A * 4/1998 Ehrenfried ..... A63B 21/023 482/129
7,083,554 B1 * 8/2006 Lo Presti ..... A63B 21/155 482/100
7,150,682 B2 * 12/2006 Varner ..... A63B 21/023 473/257
10,549,152 B2 * 2/2020 Walker ..... A63B 21/4049
2002/0198086 A1 * 12/2002 Hawthorne ..... A63B 21/151 482/92
2005/0014571 A1 * 1/2005 Varner ..... A63B 21/155 473/257
2005/0227827 A1 * 10/2005 Liester ..... A63B 21/00069 482/93
2007/0161472 A1 * 7/2007 Drechsler ..... A63B 21/4045 482/100
2010/0144496 A1 * 6/2010 Schmidt ..... A63B 21/4035 482/70
2016/0279459 A1 * 9/2016 Walker ..... A63B 23/1209
2017/0319889 A1 * 11/2017 Cei ..... A63B 21/0056
2018/0177670 A1 * 6/2018 Shim ..... A61H 1/0262
2018/0361200 A1 * 12/2018 Walker ..... A63B 21/4034
2019/0009126 A1 * 1/2019 Davison ..... A63B 21/4045
2020/0061406 A1 * 2/2020 Chuang ..... A63B 21/045

* cited by examiner

TWO-WAY RECIPROCATING STRUCTURE

RELATED APPLICATIONS

This application claims priority to China Application Serial Number 201821371598.5, filed Aug. 24, 2018, which is herein incorporated by reference.

BACKGROUND

Technical Field

The present disclosure relates to a reciprocating structure. More particularly, the present disclosure relates to a two-way reciprocating structure.

Description of Related Art

Since fitness exercises are very helpful for physical exercise, a variety of fitness equipments are widely used, such as an abdominal wheel exerciser which allows a bodybuilder to bend the body to the ground for reciprocating training, and makes the abdominal muscles, the waist and the buttocks, the arm and other parts of the body can be trained and stretched so as to promote health. Therefore, the abdominal wheel exerciser is a better product for modern people who want to exercise. However, there are still many shortcomings in the conventional abdominal wheel exerciser for the function or movement of the abdominal wheel exerciser.

Conventional fitness equipments having reciprocating structures are mainly composed of grips held by the user and a wheel coupled to the grips. One kind of the conventional fitness equipments has an elastic member and two of grips which are foldable or detachable. The grips can be held by the user, and when the wheel rotates in a clockwise direction, the elastic member is compressed to rotate the wheel in a counterclockwise direction, and the reciprocating force of the elastic member can assist the user to return to the posture.

Although the aforementioned fitness equipments with reciprocating structures can achieve the intended abdominal exercise or exercise purposes, they cannot be changed to other sporting modes, and cannot provide other ways of the fitness exercise, which are difficult for the user to accept. Moreover, it is hard to decrease the cost due to the complex structures of conventional fitness equipments. Therefore, there is a lack of a two-way reciprocating structure in the market, which can provide a two-way reciprocating exercise and also has a simple structure and low cost, so as to meet the general public demand.

SUMMARY

According to one aspect of the present disclosure, a two-way reciprocating structure includes a body, a rotational axis assembly, a flexible element and a reciprocating member. The rotational axis assembly is disposed on the body. The flexible element has a first flexible end and a second flexible end, the first flexible end is connected to the rotational axis assembly, wherein the rotational axis assembly is rotated by a force along a rotating direction to wind the flexible element around the rotational axis assembly, and the rotating direction is a clockwise direction or a counterclockwise direction. The reciprocating member has a first reciprocating end and a second reciprocating end. The first reciprocating end is disposed on the body, and the second reciprocating end is connected to the second flexible end and is simultaneously displaced with the second flexible end, wherein the rotational axis assembly is restored via a restoring force relative to the force provided by the reciprocating member.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1A:
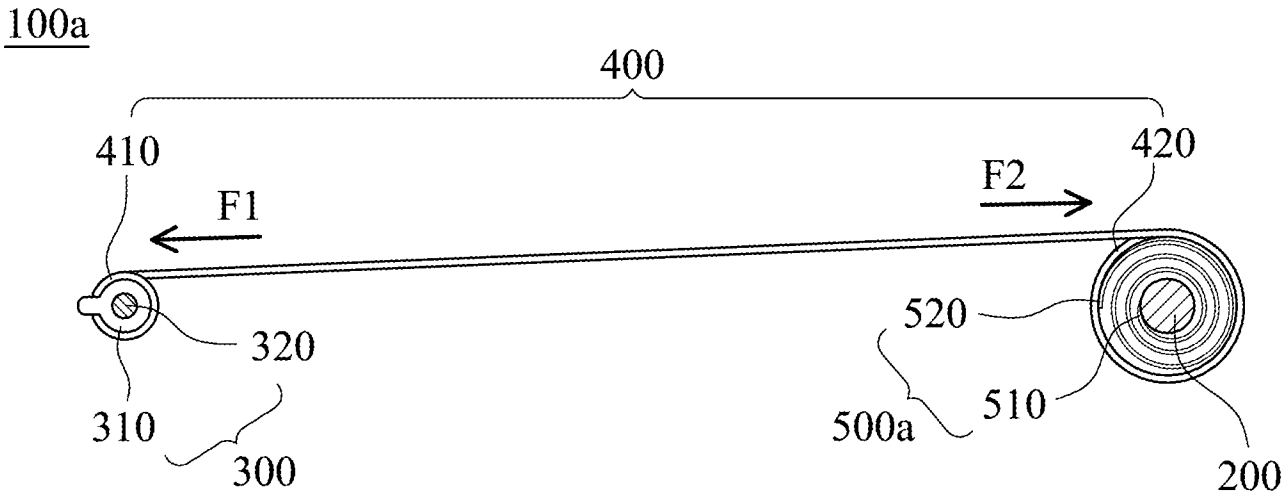
FIG. 1A is a schematic view of a two-way reciprocating structure according to the 1st embodiment of the present disclosure.
Figure 1B:
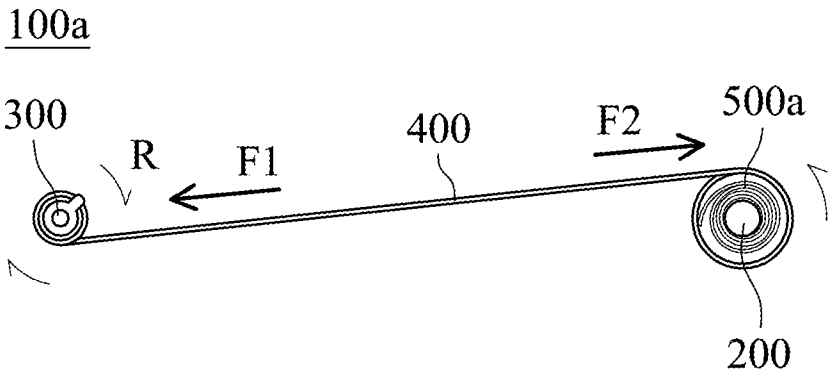
FIG. 1B is a schematic view of a rotational axis assembly rotating in a clockwise direction of FIG. 1A.
Figure 1C:
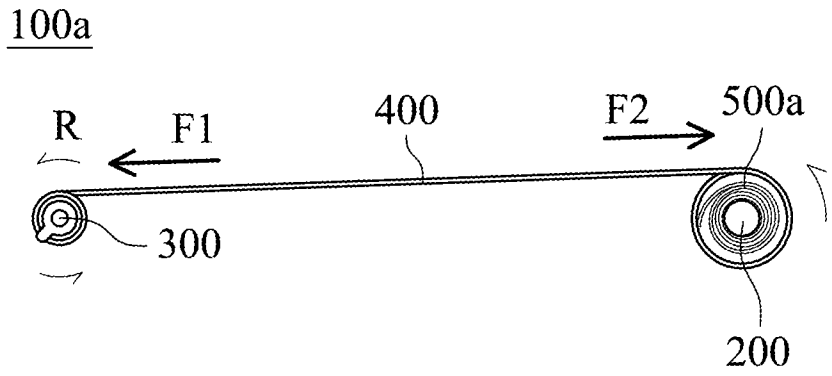
FIG. 1C is a schematic view of the rotational axis assembly rotating in a counterclockwise direction of FIG. 1A.

Please refer to FIG. 1A, FIG. 1B, and FIG. 1C, FIG. 1A is a schematic view of a two-way reciprocating structure 100*a* according to the 1st embodiment of the present disclosure, FIG. 1B is a schematic view of the rotational axis assembly 300 rotating in a clockwise direction of FIG. 1A, and FIG. 1C is a schematic view of the rotational axis assembly 300 rotating in a counterclockwise direction of FIG. 1A. As shown in FIG. 1A, FIG. 1B, and FIG. 1C, the two-way reciprocating structure 100*a* includes a body 200, a rotational axis assembly 300, a flexible element 400 and a reciprocating member 500*a*.

The body 200 is made by a rigid material. The reciprocating member 500*a* is disposed on the body 200 for operating the reciprocating member 500*a*. According to the 1st embodiment, the body 200 is a fixing axis.

The rotational axis assembly 300 includes a furling base 310 and a central axis 320. The furling base 310 is disposed around the central axis 320 and the flexible element 400 is furled around the furling base 310. The central axis 320 is rotated by a force F1 along a rotating direction R.

The flexible element 400 includes a first flexible end 410 and a second flexible end 420, and the first flexible end 410 is connected to the rotational axis assembly 300. The rotational axis assembly 300 is rotated by the force F1 along the rotating direction R to wind the flexible element 400 around the rotational axis assembly 300, wherein the rotating direction R is a clockwise direction or a counterclockwise direction. In FIG. 1B and FIG. 1C, when the rotating direction R of the rotational axis assembly 300 is the counterclockwise direction, the flexible element 400 is furled around with a track of the furling base 310; on the contrary, when the rotating direction R of the rotational axis assembly 300 is the clockwise direction, the flexible element 400 is separated from the furling base 310 by releasing from the track of the furling base 310. According to the 1st embodiment, the flexible element 400 can include a nylon rope, a ribbon or a steel rope. By the arrangement of the flexible strip-shaped element, the flexible element 400 can be well furled around the rotational axis assembly 300 or released from the rotational axis assembly 300.

The reciprocating member 500*a* has a first reciprocating end 510 and a second reciprocating end 520, the first reciprocating end 510 is disposed on the body 200, and the second reciprocating end 520 is connected to the second flexible end 420 and is simultaneously displaced with the second flexible end 420. The rotational axis assembly 300 is restored via a restoring force F2 relative to the force F1 provided by the reciprocating member 500*a*. In detail, the reciprocating member 500*a* is a scroll spring connected between the body 200 and the second flexible end 420. In FIG. 1B, when the rotating direction R is the clockwise direction and the force F1 is greater than the restoring force F2, the scroll spring is rotated in the counterclockwise direction. In FIG. 1C, when the rotating direction R is the counterclockwise direction and the force F1 is greater than the restoring force F2, the scroll spring is rotated in the counterclockwise direction. Therefore, in the two-way reciprocating structure 100*a* of the 1st embodiment, the reciprocating member 500*a* being the scroll spring can perform the elasticity in both of the clockwise rotating direction and the counterclockwise rotating direction by cooperating with the rotational axis assembly 300, so that the restoring force F2 opposite to the force F1 can be generated. Thus, it is favorable for providing the two-way reciprocating structure 100*a* can have characteristics of simple structure and low cost, and can also provide reciprocating operation.

Figure 2A:
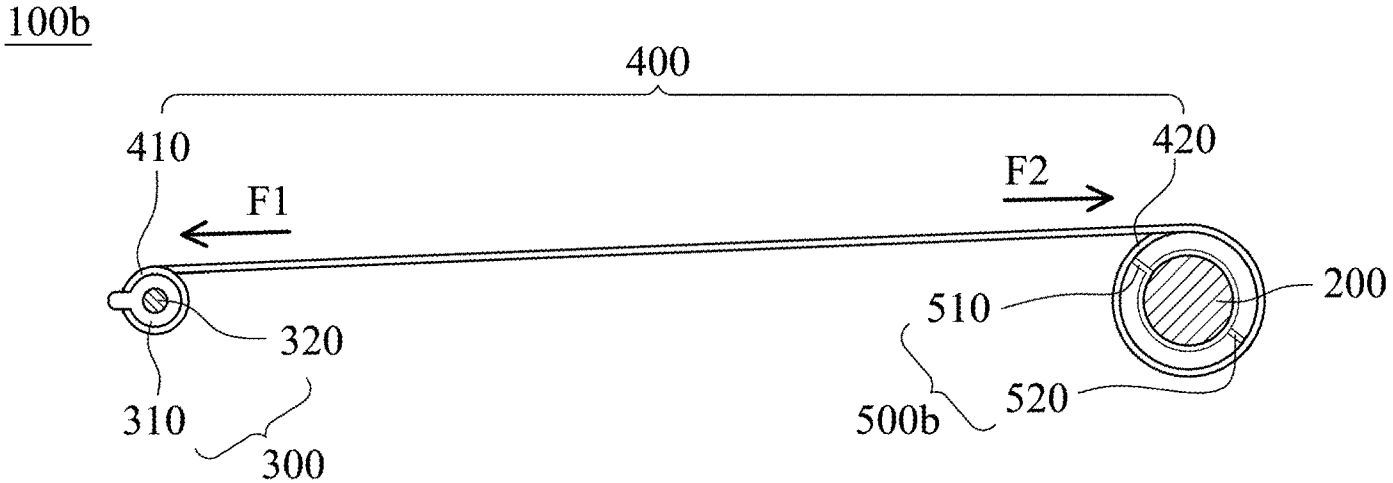
FIG. 2A is a schematic view of the two-way reciprocating structure according to the 2nd embodiment of the present disclosure.
Figure 2B:
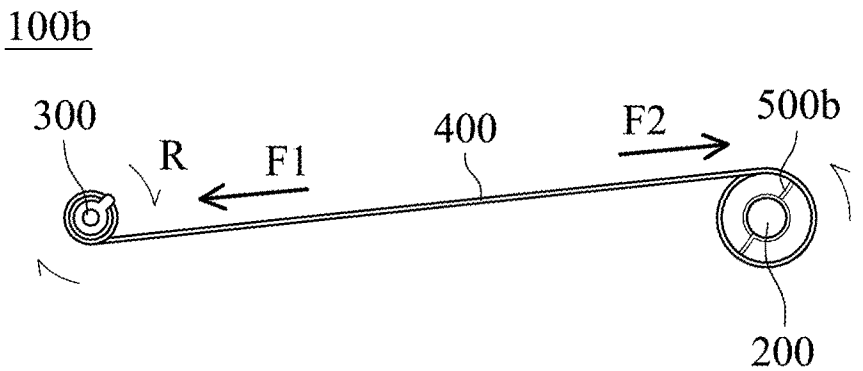
FIG. 2B is a schematic view of the rotational axis assembly rotating in a clockwise direction of FIG. 2A.
Figure 2C:
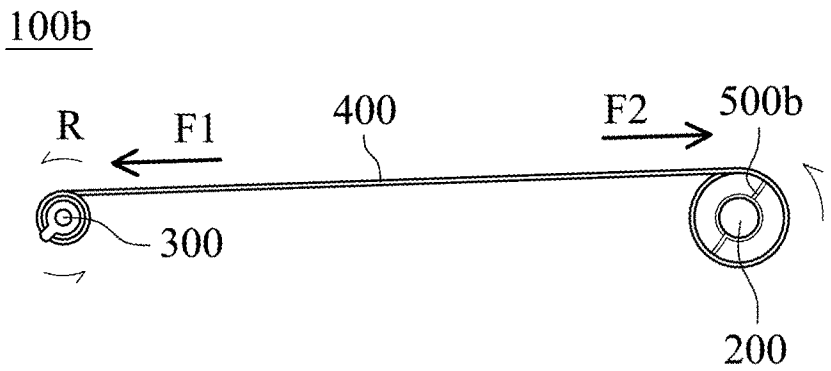
FIG. 2C is a schematic view of the rotational axis assembly rotating in a counterclockwise direction of FIG. 2A.

Please refer to FIG. 1A, FIG. 2A, FIG. 2B and FIG. 2C together. FIG. 2A is a schematic view of the two-way reciprocating structure 100*b* according to the 2nd embodiment of the present disclosure. FIG. 2B is a schematic view of the rotational axis assembly 300 rotating in a clockwise direction of FIG. 2A. FIG. 2C is a schematic view of the rotational axis assembly 300 rotating in a counterclockwise direction of FIG. 2A. As shown in FIG. 2A, FIG. 2B and FIG. 2C, the two-way reciprocating structure 100*b* includes a body 200, a rotational axis assembly 300, a flexible element 400 and a reciprocating member 500*b*.

According to the 2nd embodiment of FIG. 2A, the structure of the body 200, the rotational axis assembly 300 and the flexible element 400 are the same as the structure of the body 200, the rotational axis assembly 300 and the flexible element 400 of the 1st embodiment in FIG. 1A, and will not be described herein. According to the 2nd embodiment of FIG. 2A, the two-way reciprocating structure 100*b* further includes the reciprocating member 500*b*, wherein the reciprocating member 500*b* is a torsion spring connected between the body 200 and the second flexible end 420. In FIG. 2B, the flexible element 400 is furled around the furling base 310 along the clockwise direction from the lower side of the rotational axis assembly 300. When the rotating direction R is the clockwise direction and the force F1 is greater than the restoring force F2, the torsion spring is rotated in the counterclockwise direction. In FIG. 2C, the flexible element 400 is furled around the furling base 310 along the counterclockwise direction from the upper side of the rotational axis assembly 300. When the rotating direction R is the counterclockwise direction and the force F1 is greater than the restoring force F2, the torsion spring is rotated in the counterclockwise direction. Therefore, in the two-way reciprocating structure 100*b* of the 2nd embodiment, the reciprocating member 500*b* being the torsion spring can perform the elasticity in both of the clockwise rotating direction and the counterclockwise rotating direction by cooperating with the rotational axis assembly 300, so that the restoring force F2 opposite to the force F1 can be generated. Thus, it is favorable for providing the two-way reciprocating structure 100*b* can have characteristics of simple structure and low cost, and can also provide reciprocating operation.

Figure 3A:
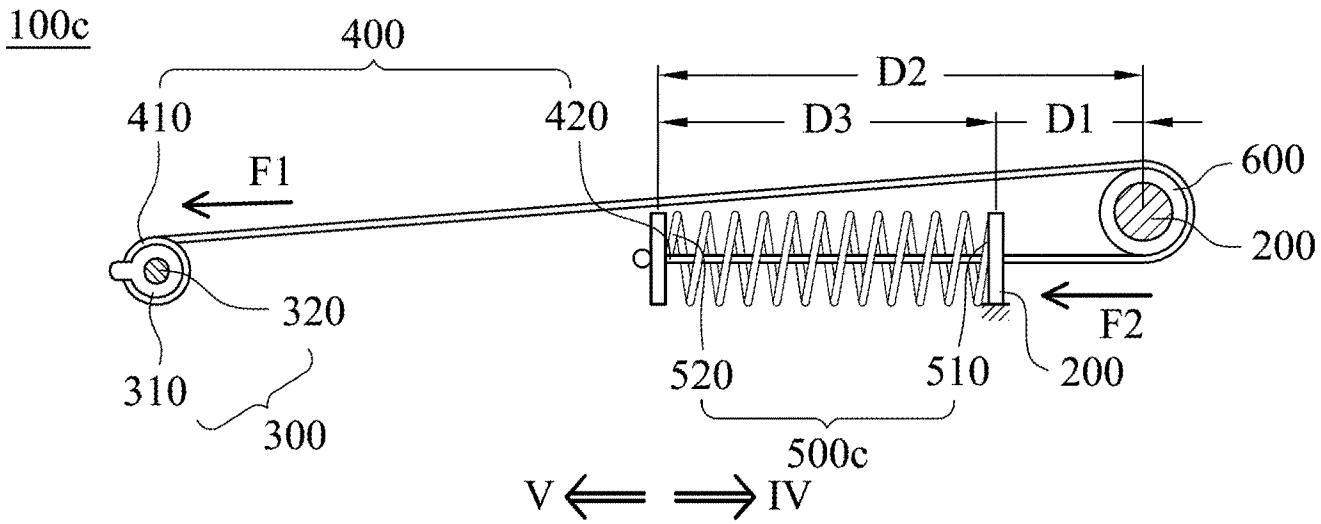
FIG. 3A is a schematic view of the two-way reciprocating structure according to the 3rd embodiment of the present disclosure.
Figure 3B:
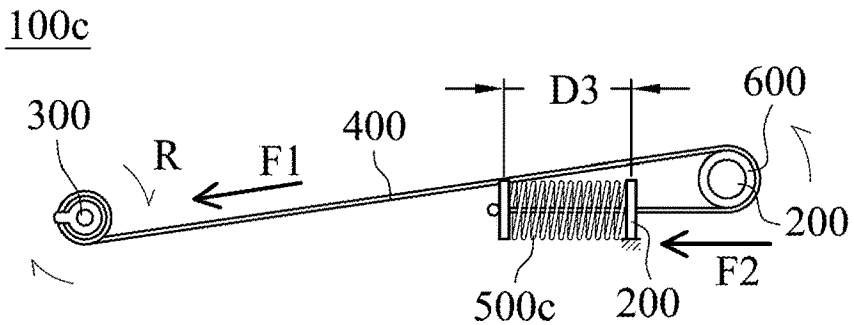
FIG. 3B is a schematic view of the rotational axis assembly rotating in a clockwise direction of FIG. 3A.
Figure 3C:
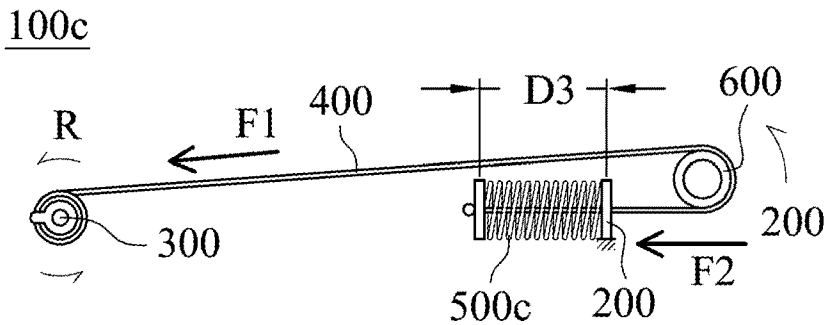
FIG. 3C is a schematic view of the rotational axis assembly rotating in a counterclockwise direction of FIG. 3A.

Please refer to FIG. 1A, FIG. 3A, FIG. 3B and FIG. 3C together. FIG. 3A is a schematic view of the two-way reciprocating structure 100*c* according to the 3rd embodiment of the present disclosure. FIG. 3B is a schematic view of the rotational axis assembly 300 rotating in a clockwise direction of FIG. 3A. FIG. 3C is a schematic view of the rotational axis assembly 300 rotating in a counterclockwise direction of FIG. 3A. As shown in FIG. 3A, FIG. 3B and FIG. 3C, the two-way reciprocating structure 100*c* includes a body 200, a rotational axis assembly 300, a flexible element 400, a reciprocating member 500*c* and a pulley 600.

According to the 3rd embodiment of FIG. 3A, the structure of the body 200, the rotational axis assembly 300 and the flexible element 400 are the same as the structure of the body 200, the rotational axis assembly 300 and the flexible element 400 of the 1st embodiment in FIG. 1A, and will not be described herein. According to the 3rd embodiment of FIG. 3A, the two-way reciprocating structure 100*c* further includes the reciprocating member 500*c* and the pulley 600, wherein the reciprocating member 500*c* is a compression spring connected between the body 200 and the second flexible end 420. The distance D1 between the first reciprocating end 510 and the pulley 600 is smaller than the distance D2 between the second reciprocating end 520 and the pulley 600. Furthermore, the pulley 600 is disposed on the body 200 and is rotationally connected to the flexible element 400, and the pulley 600 is simultaneously actuated with the rotational axis assembly 300, the flexible element 400 and the second reciprocating end 520. In the 3rd embodiment, the pulley 600 is an idler pulley which is for adjusting the direction of the flexible element 400. When the force F1 is smaller than the restoring force F2, the second reciprocating end 520 and the second flexible end 420 are displaced along a restoring direction V. When the force F1 is greater than the restoring force F2, the second reciprocating end 520 and the second flexible end 420 are displaced along an anti-restoring direction IV. When the force F1 is equal to the restoring force F2, the second reciprocating end 520 and the second flexible end 420 are stationary. Moreover, in FIG. 3B, the flexible element 400 is furled around the furling base 310 in the clockwise direction from the lower side of the rotational axis assembly 300. When the rotating direction R is the clockwise direction and the force F1 is greater than the restoring force F2, the pulley 600 is rotated in the counterclockwise direction, and the second reciprocating end 520 is approached to the first reciprocating end 510 so as to shorten the length of the compression spring D3. In FIG. 3C, the flexible element 400 is furled around the furling base 310 in the counterclockwise direction from the upper side of the rotational axis assembly 300. When the rotating direction R is the counterclockwise direction and the force F1 is greater than the restoring force F2, the pulley 600 is rotated in the counterclockwise direction, and the second reciprocating end 520 is approached to the first reciprocating end 510 so as to shorten the length of the compression spring D3. Therefore, in the two-way reciprocating structure 100*c* of the 3rd embodiment, the reciprocating member 500*c* being the compression spring can perform the elasticity in both of the clockwise rotating direction and the counterclockwise rotating direction by cooperating with the rotational axis assembly 300, so that the restoring force F2 opposite to the force F1 can be generated. Thus, it is favorable for providing the two-way reciprocating structure 100*c* can have characteristics of simple structure and low cost, and can also provide reciprocating operation.

Figure 4A:
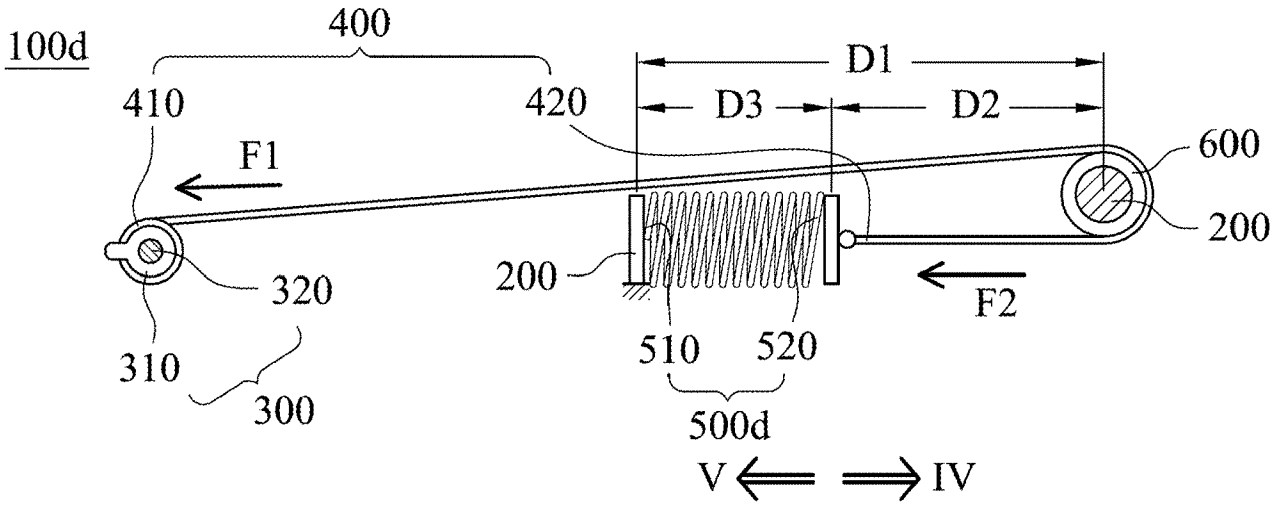
FIG. 4A is a schematic view of the two-way reciprocating structure according to the 4th embodiment of the present disclosure.
Figure 4C:
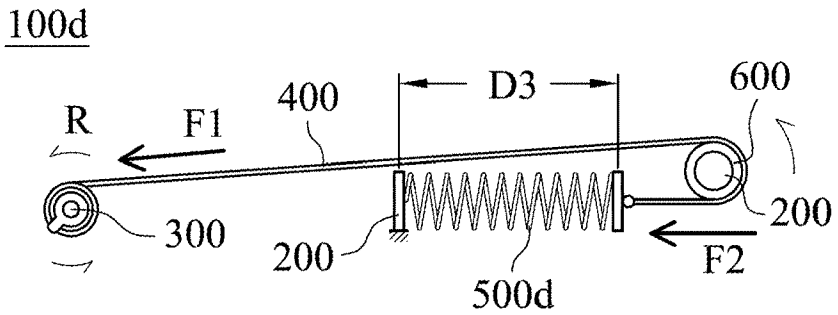
FIG. 4C is a schematic view of the rotational axis assembly rotating in a counterclockwise direction of FIG. 4A.
Figure 4B:
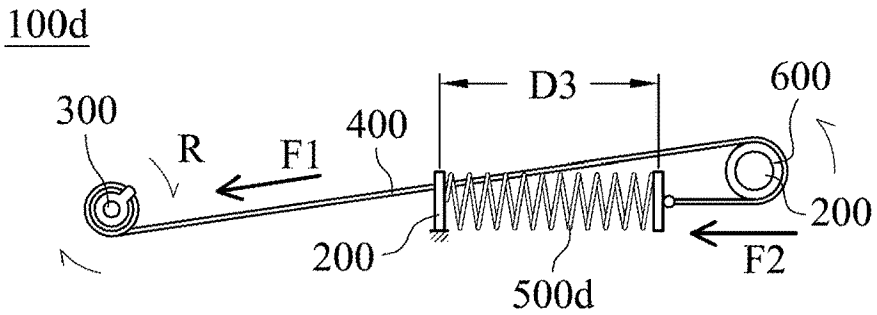
FIG. 4B is a schematic view of the rotational axis assembly rotating in a clockwise direction of FIG. 4A.

Please refer to FIG. 3A, FIG. 4A, FIG. 4B and FIG. 4C together. FIG. 4A is a schematic view of the two-way reciprocating structure 100*d* according to the 4th embodiment of the present disclosure. FIG. 4B is a schematic view of the rotational axis assembly 300 rotating in a clockwise direction of FIG. 4A. FIG. 4C is a schematic view of the rotational axis assembly 300 rotating in a counterclockwise direction of FIG. 4A. As shown in FIG. 4A, FIG. 4B and FIG. 4C, the two-way reciprocating structure 100*d* includes a body 200, a rotational axis assembly 300, a flexible element 400, a reciprocating member 500*d* and a pulley 600.

According to the 4th embodiment of FIG. 4A, the structure of the body 200, the rotational axis assembly 300, the flexible element 400 and the pulley 600 are the same as the structure of the body 200, the rotational axis assembly 300, the flexible element 400 and the pulley 600 of the 3rd embodiment in FIG. 3A, and will not be described herein. According to the 4th embodiment of FIG. 4A, the two-way reciprocating structure 100*d* further includes the reciprocating member 500*d*, wherein the reciprocating member 500*d* is an extension spring connected between the body 200 and the second flexible end 420. The distance D1 between the first reciprocating end 510 and the pulley 600 is greater than the distance D2 between the second reciprocating end 520 and the pulley 600. Moreover, in FIG. 4B, the flexible element 400 is furled around the furling base 310 in the clockwise direction from the lower side of the rotational axis assembly 300. When the rotating direction R is the clockwise direction and the force F1 is greater than the restoring force F2, the pulley 600 is rotated in the counterclockwise direction, and the second reciprocating end 520 is leaved from the first reciprocating end 510 so as to increase the length of the extension spring D3. In FIG. 4C, the flexible element 400 is furled around the furling base 310 in the counterclockwise direction from the upper side of the rotational axis assembly 300. When the rotating direction R is the counterclockwise direction and the force F1 is greater than the restoring force F2, the pulley 600 is rotated in the counterclockwise direction, and the second reciprocating end 520 is leaved from the first reciprocating end 510 so as to increase the length of the extension spring D3. Therefore, in the two-way reciprocating structure 100*d* of the 4th embodiment, the reciprocating member 500*d* being the extension spring can perform the elasticity in both of the clockwise rotating direction and the counterclockwise rotating direction by cooperating with the rotational axis assembly 300, so that the restoring force F2 opposite to the force F1 can be generated and the function of reciprocating motion can be provided. Moreover, due to the simple structure of the two-way reciprocating structure 100*d*, the two-way reciprocating structure 100*d* can be widely applied to various types of the sport equipments or the fitness equipments which need reciprocating operation.

Figure 5A:
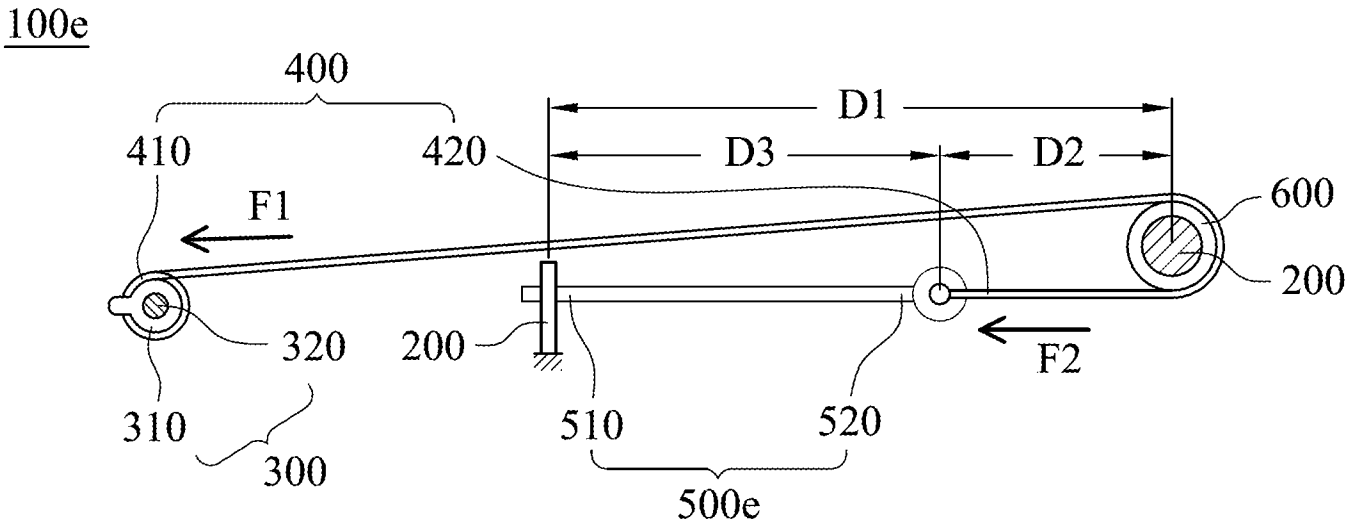
FIG. 5A is a schematic view of the two-way reciprocating structure according to the 5th embodiment of the present disclosure.
Figure 5C:
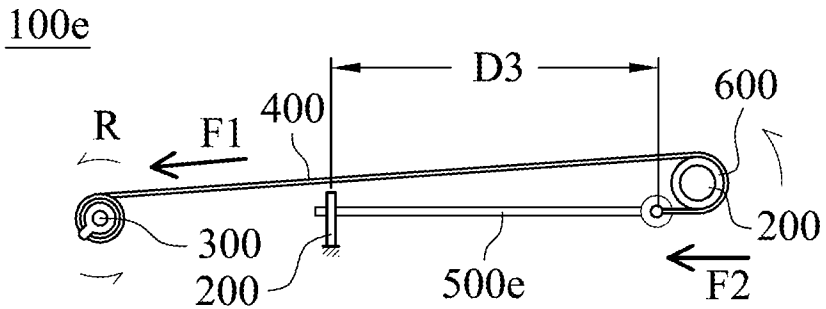
FIG. 5C is a schematic view of the rotational axis assembly rotating in a counterclockwise direction of FIG. 5A.
Figure 5B:
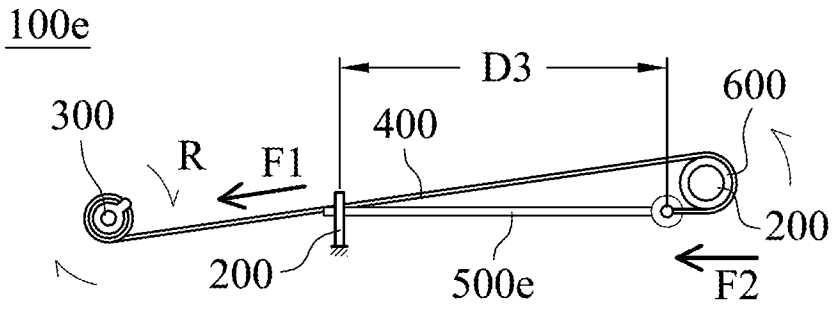
FIG. 5B is a schematic view of the rotational axis assembly rotating in a clockwise direction of FIG. 5A.

Please refer to FIG. 4A, FIG. 5A, FIG. 5B and FIG. 5C together. FIG. 5A is a schematic view of the two-way reciprocating structure 100*e* according to the 5th embodiment of the present disclosure. FIG. 5B is a schematic view of the rotational axis assembly 300 rotating in a clockwise direction of FIG. 5A. FIG. 5C is a schematic view of the rotational axis assembly 300 rotating in a counterclockwise direction of FIG. 5A. As shown in FIG. 5A, FIG. 5B and FIG. 5C, the two-way reciprocating structure 100*e* includes a body 200, a rotational axis assembly 300, a flexible element 400, a reciprocating member 500*e* and a pulley 600.

According to the 5th embodiment of FIG. 5A, the structure of the body 200, the rotational axis assembly 300, the flexible element 400 and the pulley 600 are the same as the structure of the body 200, the rotational axis assembly 300, the flexible element 400 and the pulley 600 of the 4th embodiment in FIG. 4A, and will not be described herein. According to the 5th embodiment of FIG. 5A, the two-way reciprocating structure 100*e* further includes the reciprocating member 500*e*, wherein the reciprocating member 500*e* is a rope connected between the body 200 and the second flexible end 420. The distance D1 between the first reciprocating end 510 and the pulley 600 is greater than the distance D2 between the second reciprocating end 520 and the pulley 600. Moreover, in FIG. 5B, the flexible element 400 is furled around the furling base 310 in the clockwise direction from the lower side of the rotational axis assembly 300. When the rotating direction R is the clockwise direction and the force F1 is greater than the restoring force F2, the pulley 600 is rotated in the counterclockwise direction, and the second reciprocating end 520 is leaved from the first reciprocating end 510 so as to increase the length of the rope D3. When the rotating direction R is the counterclockwise direction and the force F1 is greater than the restoring force F2, the pulley 600 is rotated in the counterclockwise direction, and the second reciprocating end 520 is leaved from the first reciprocating end 510 so as to increase the length of the rope D3. Therefore, in the two-way reciprocating structure 100*e* of the 5th embodiment, the reciprocating member 500*e* being the rope can perform the elasticity in both of the clockwise rotating direction and the counterclockwise rotating direction by cooperating with the rotational axis assembly 300, so that the restoring force F2 opposite to the force F1 can be generated. Thus, it is favorable for providing the two-way reciprocating structure 100*e* can have characteristics of simple structure and low cost, and can also provide reciprocating operation.

Figure 6A:
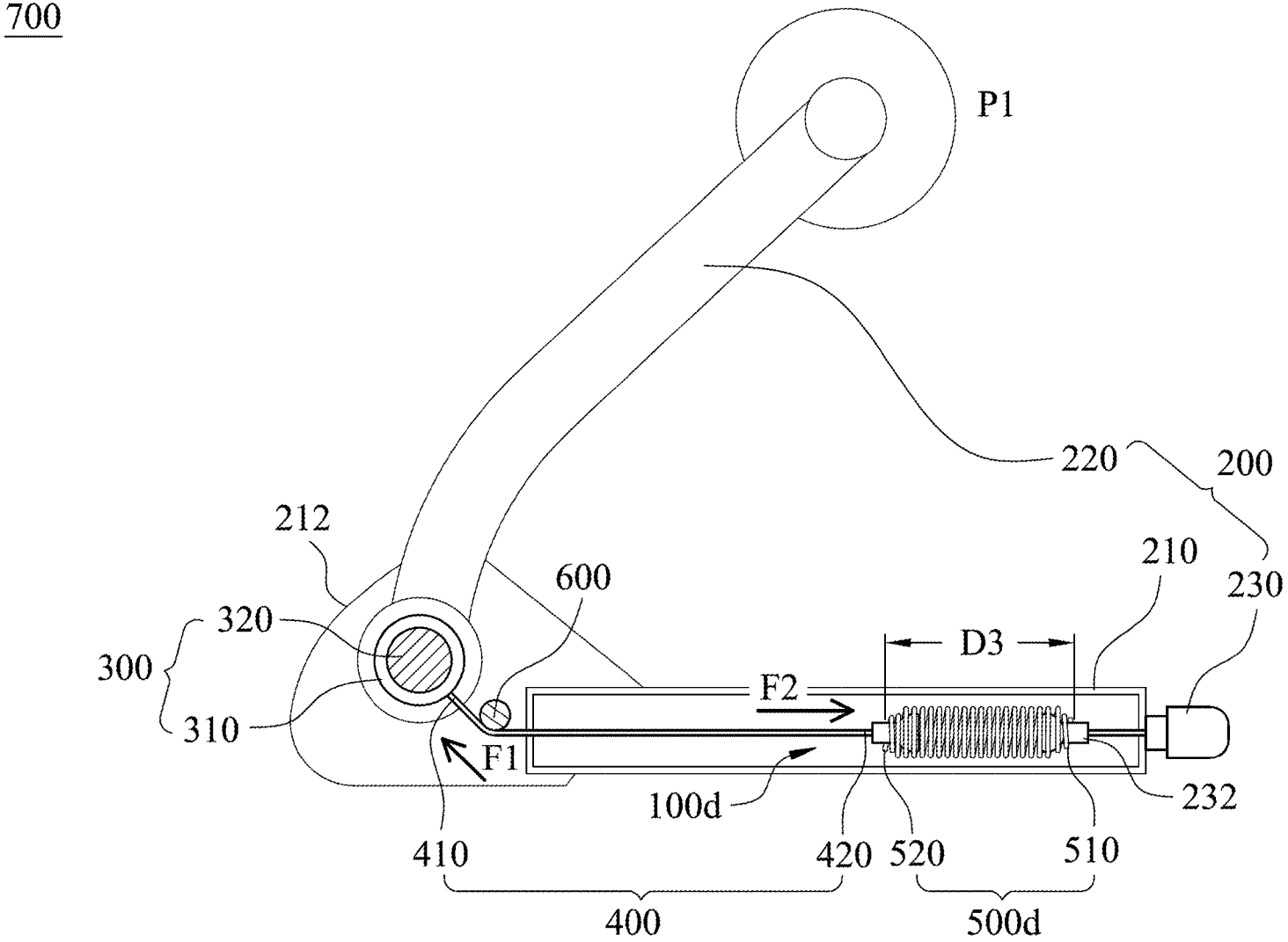
FIG. 6A is a schematic view of the two-way reciprocating structure applied to the fitness equipment of FIG. 4A.
Figure 6B:
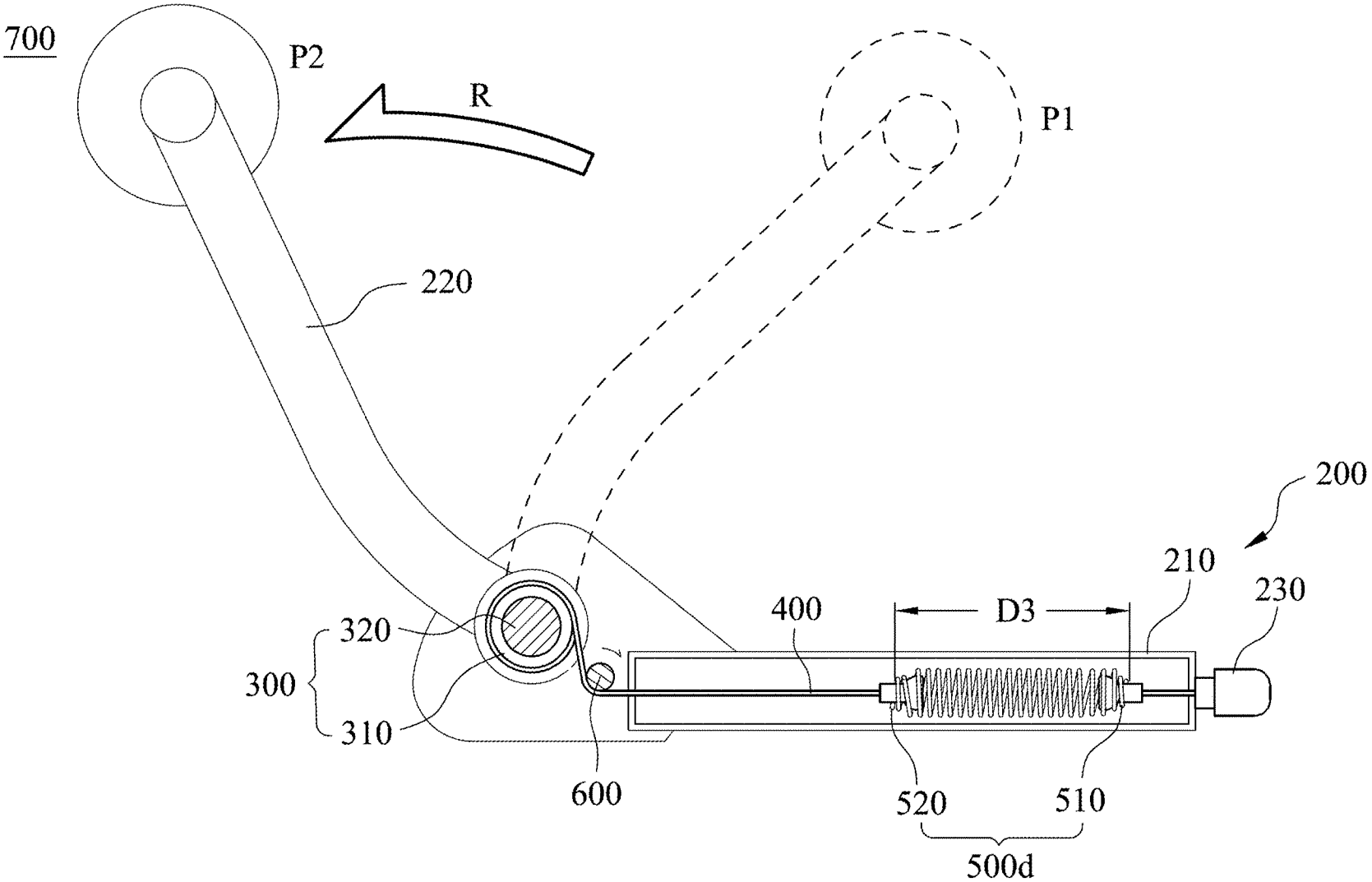
FIG. 6B is a schematic view of a first operation of the fitness equipment of FIG. 6A.
Figure 6C:
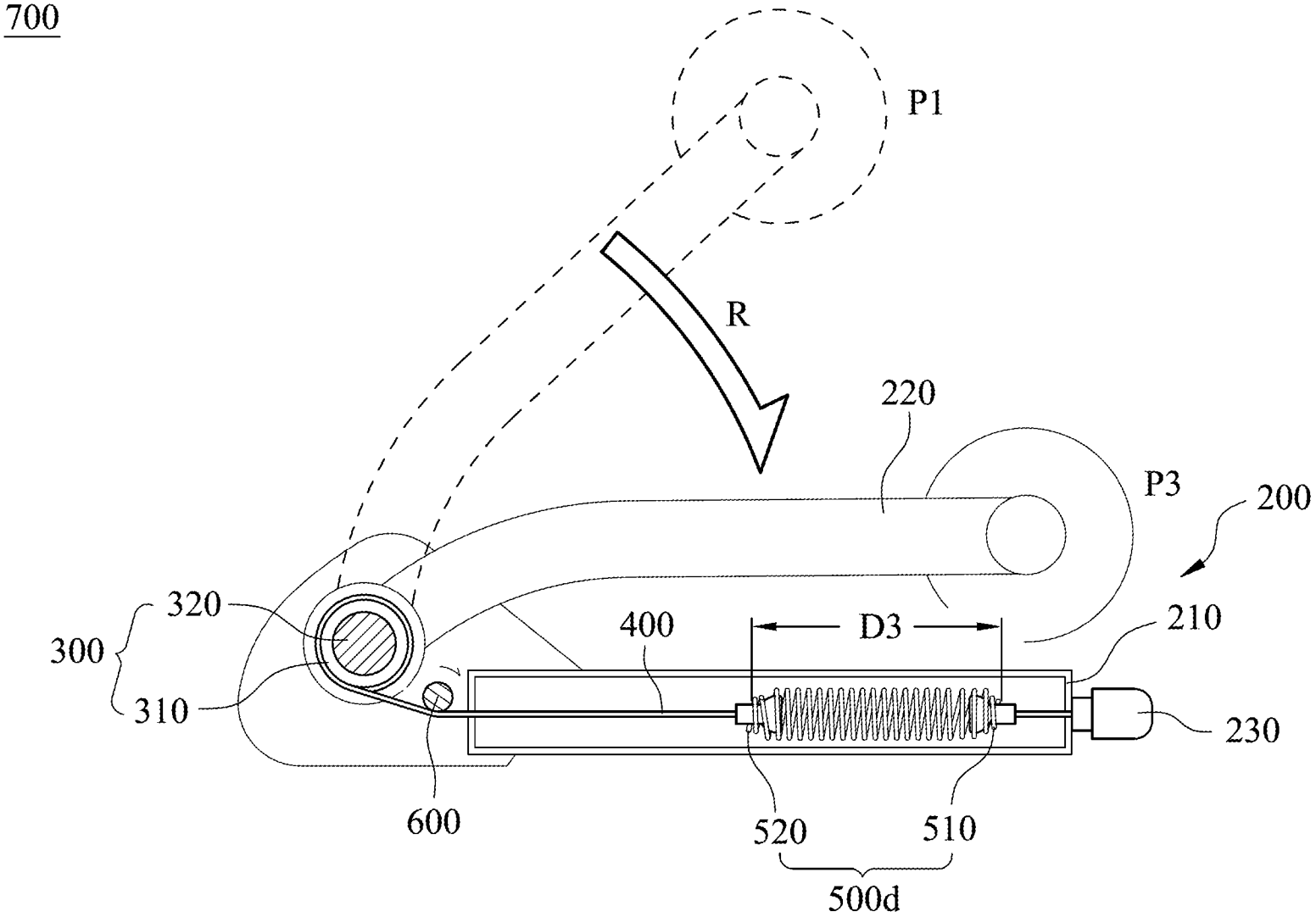
FIG. 6C is a schematic view of a second operation of the fitness equipment of FIG. 6A.

Please refer to FIG. 4A, FIG. 6A, FIG. 6B and FIG. 6C together. FIG. 6A is a schematic view of the two-way reciprocating structure 100*d* applied to a fitness equipment 700 of FIG. 4A. FIG. 6B is a schematic view of a first operation of the fitness equipment 700 of FIG. 6A. FIG. 6C is a schematic view of a second operation of the fitness equipment 700 of FIG. 6A. As shown in FIG. 6A, FIG. 6B and FIG. 6C, the fitness equipment 700 includes a body 200, a rotational axis assembly 300, a flexible element 400, a reciprocating member 500*d* and a pulley 600.

According to the embodiment of FIG. 6A, the structure of the rotational axis assembly 300, the flexible element 400, the reciprocating member 500*d* and the pulley 600 are the same as the structure of the rotational axis assembly 300, the flexible element 400, reciprocating member 500*d* and the pulley 600 of the 4th embodiment in FIG. 4A, and will not be described herein. According to the embodiment of FIG. 6A, the body 200 of the fitness equipment 700 includes a first support 210, a second support 220 and an adjusting module 230, wherein the first support 210 is connected to the second support 220 and includes an axis connecting portion 212. The second support 220 is connected to the central axis 320 of the rotational axis assembly 300, the central axis 320 is pivotally disposed on the axis connecting portion 212; in other words, the second support 220 is pivotally connected to the first support 210 via the rotational axis assembly 300. Moreover, the adjusting module 230 is disposed on the first support 210 and includes a reciprocation connecting portion 232. The second reciprocating end 520 of the reciprocating member 500*d* (which is the extension spring) is connected to the reciprocation connecting portion 232. The adjusting module 230 can adjust the position of the reciprocation connecting portion 232, that is, the position of the second reciprocating end 520 can be adjusted. Furthermore, in FIG. 6A, the second support 220 is in a stationary state without any external force, at the same time, the second support 220 is at a first position P1. In FIG. 6B, the second support 220 is rotated in the counterclockwise direction by an external force which is moved to a second position P2, at the same time, the flexible element 400 is furled around the furling base 310 in the counterclockwise direction from the upper side of the rotational axis assembly 300. When the rotating direction R is the counterclockwise direction and the force F1 is greater than the restoring force F2, the pulley 600 is rotated in the clockwise direction, and the second reciprocating end 520 is leaved from the first reciprocating end 510 so as to increase the length of the extension spring D3. When the force F1 is smaller than the restoring force F2, the second support 220 is returned from the second position P2 to the first position P1 in the clockwise direction. Furthermore, in FIG. 6C, the second support 220 is rotated in the clockwise direction by the external force to move to a third position P3, at the same time, the flexible element 400 is furled around the furling base 310 in the clockwise direction from the lower side of the rotational axis assembly 300. When the rotating direction R is the clockwise direction and the force F1 is greater than the restoring force F2, the pulley 600 is rotated in the clockwise direction, and the second reciprocating end 520 is leaved from the first reciprocating end 510 so as to increase the length of the extension spring D3. When the force F1 is smaller than the restoring force F2, the second support 220 is returned from the third position P3 to the first position P1 in the counterclockwise direction. It is worth to be mentioned that the extension spring (which is the reciprocating member 500*d*) of the embodiment of FIG. 6A can be replaced by the scroll spring, the torsion spring, the compression spring or the rope, and the same reciprocating action can be achieved. Therefore, in the fitness equipment 700 of the embodiment in FIG. 6A, the reciprocating member 500*d* being the extension spring can perform the elasticity in both of the clockwise rotating direction and the counterclockwise rotating direction by cooperating with the rotational axis assembly 300, so that the restoring force F2 opposite to the force F1 can be generated and the function of reciprocating motion can be provided. Thus, due to the simple structure of the fitness equipment 700, it can be widely applied to various types of sport equipments or the fitness equipments which need reciprocating operation.

Figure 7A:
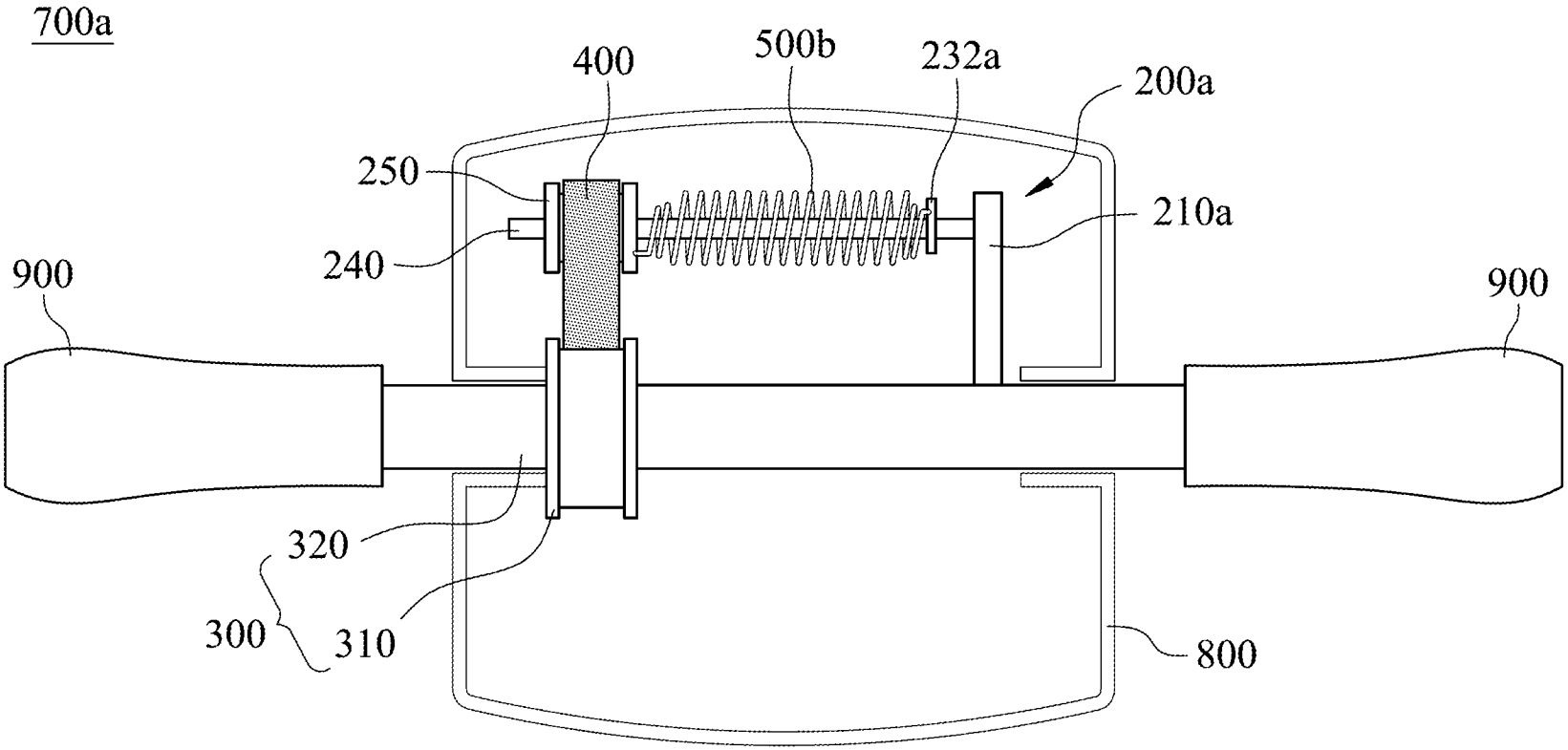
FIG. 7A is a schematic view of the two-way reciprocating structure of FIG. 2A applied to another fitness equipment of FIG. 2A.
Figure 7B:
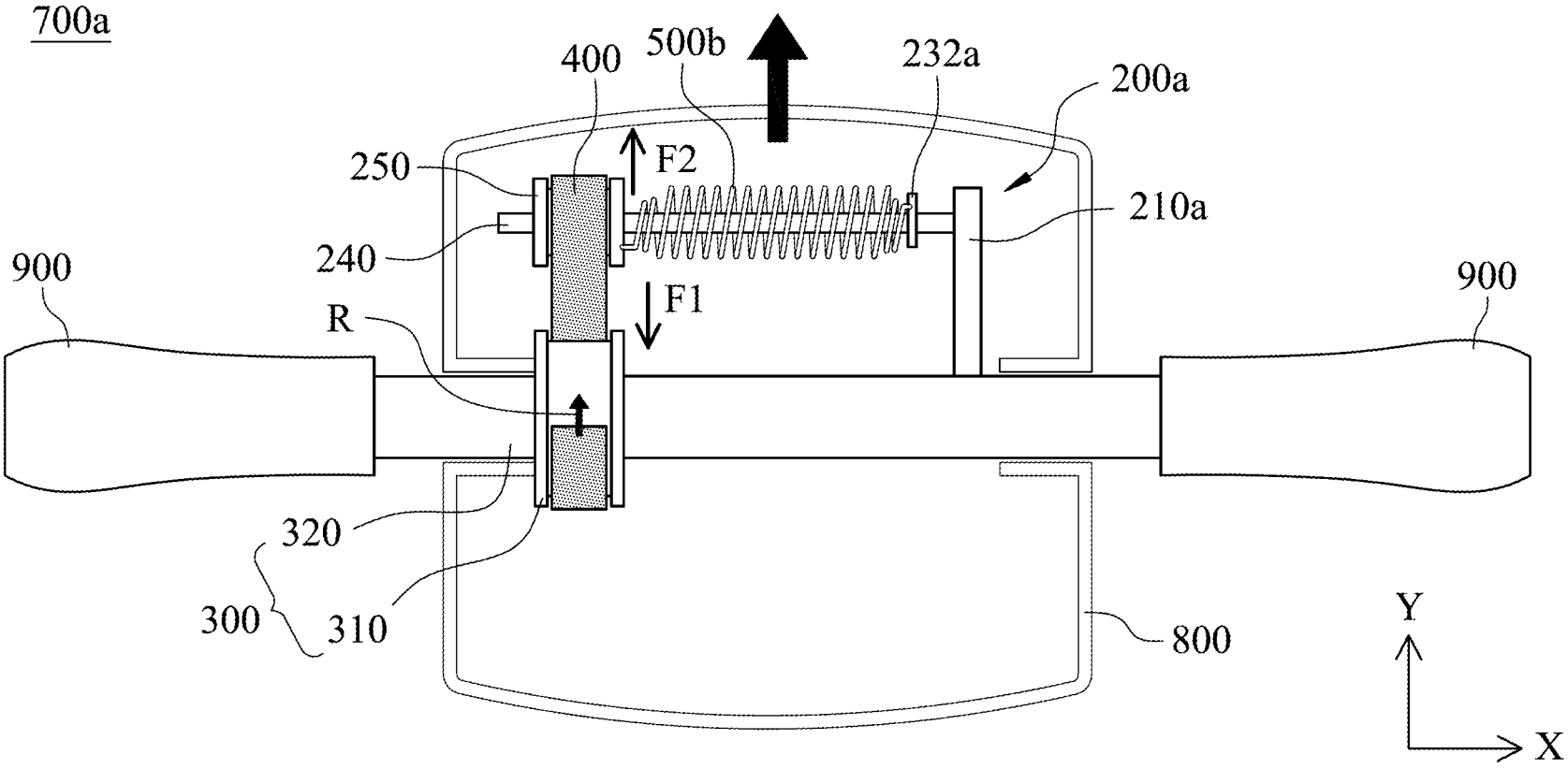
FIG. 7B is a schematic view of the first operation of the fitness equipment of FIG. 7A.
Figure 7C:
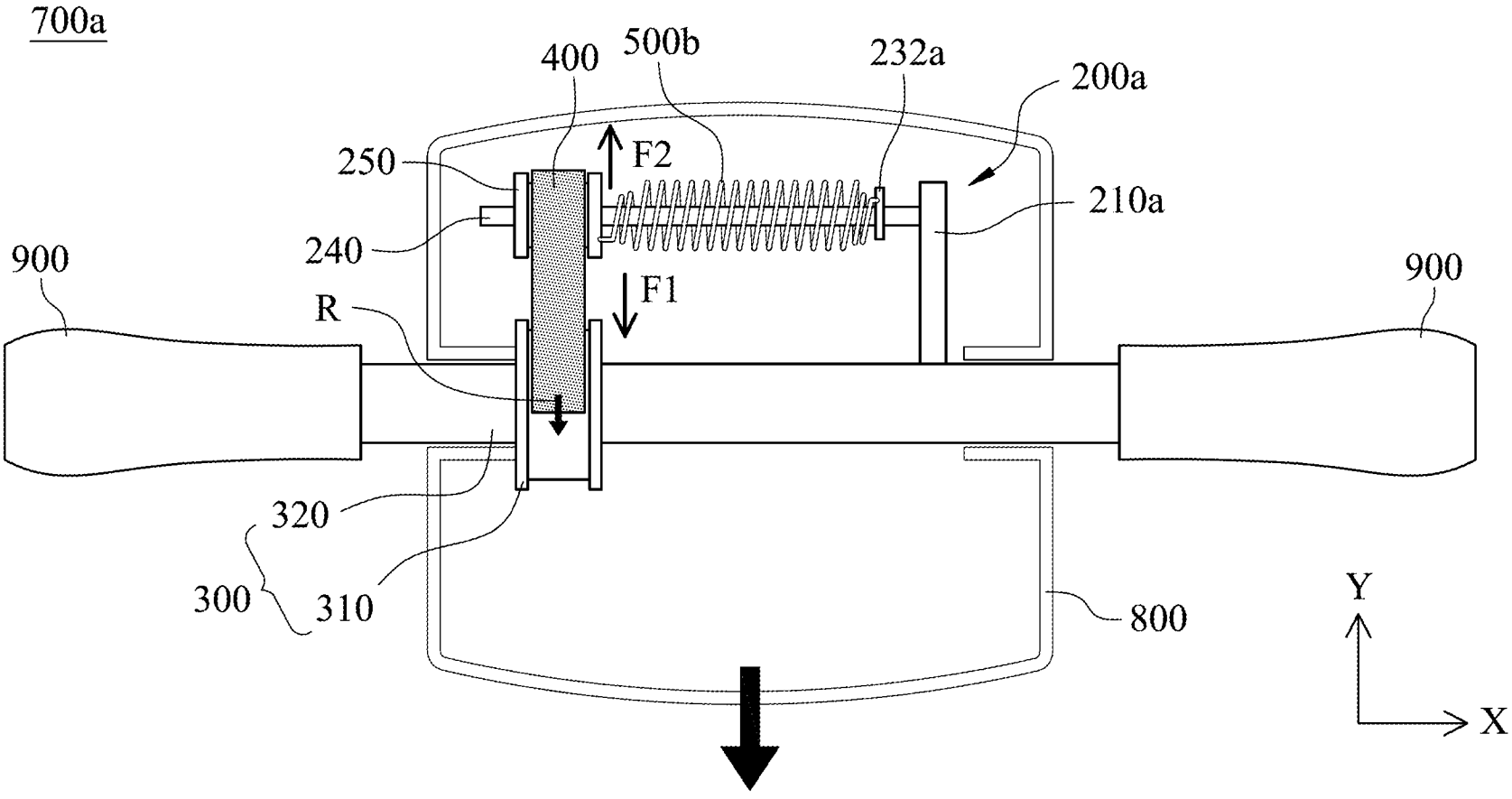
FIG. 7C is a schematic view of the second operation of the fitness equipment of FIG. 7A.
Figure 8A:
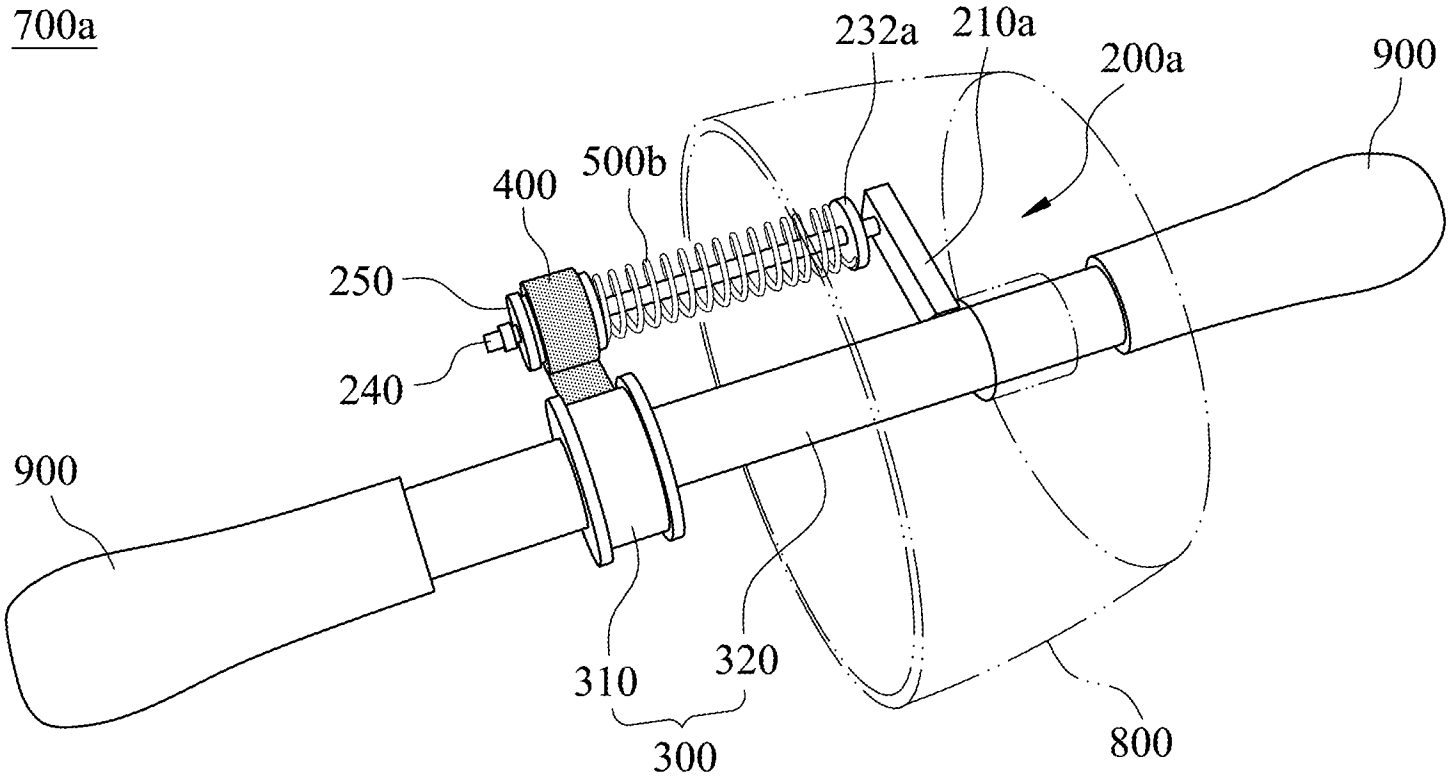
FIG. 8A is a three dimensional view of the fitness equipment of FIG. 7A.
Figure 8B:
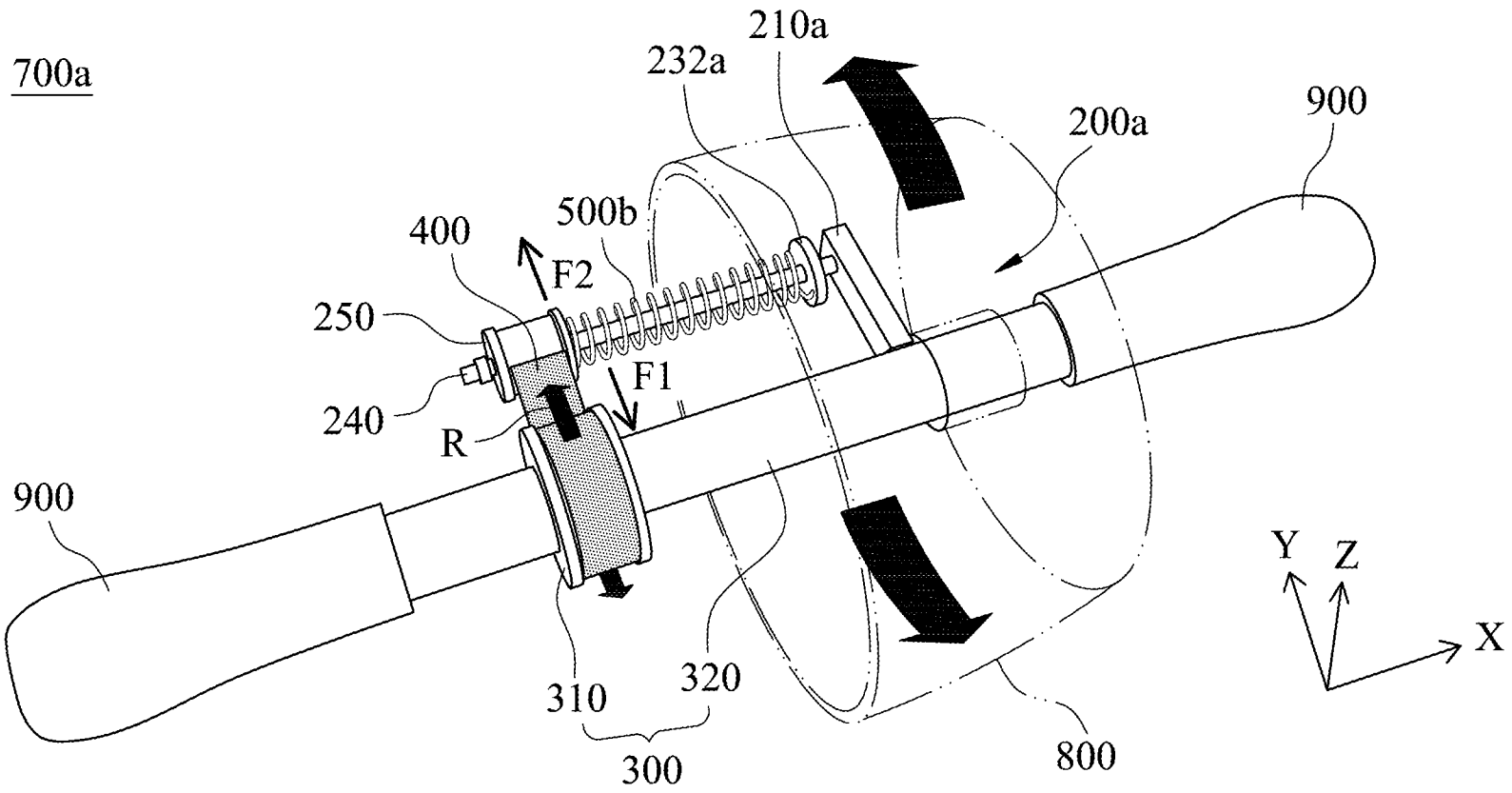
FIG. 8B is a three dimensional view of the first operation of the fitness equipment of FIG. 8A.
Figure 8C:
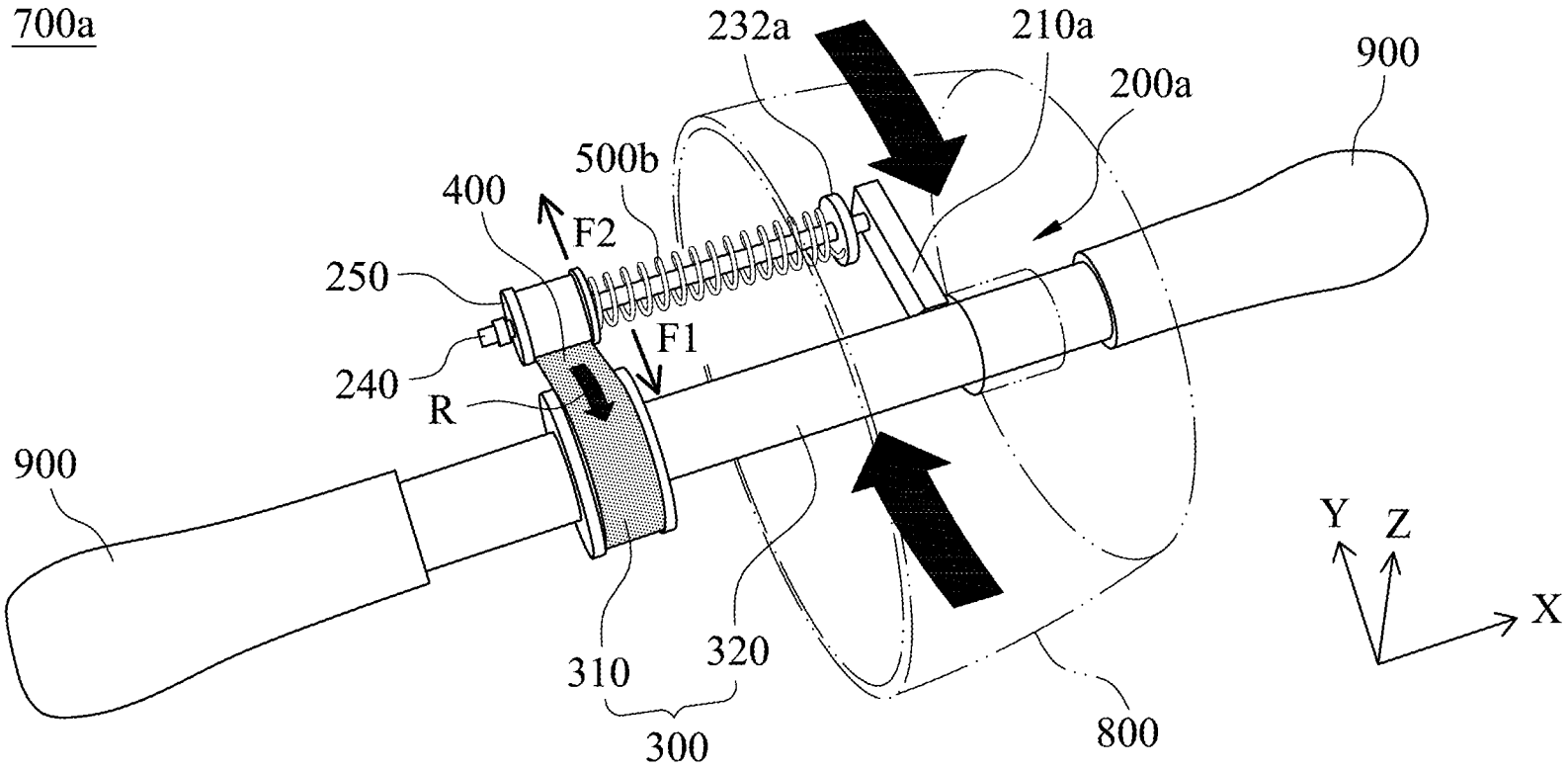
FIG. 8C is a three dimensional view of the second operation of the fitness equipment of FIG. 8A.

Please refer to FIG. 2A, FIG. 2B, FIG. 2C, FIG. 7A, FIG. 7B, FIG. 7C, FIG. 8A, FIG. 8B and FIG. 8C. FIG. 7A is a schematic view of the two-way reciprocating structure 100*b* applied to another fitness equipment 700*a* of FIG. 2A. FIG. 7B is a schematic view of the first operation of the fitness equipment 700*a* of FIG. 7A. FIG. 7C is a schematic view of the second operation of the fitness equipment 700*a* of FIG. 7A. FIG. 8A is a three dimensional view of the fitness equipment 700*a* of FIG. 7A. FIG. 8B is a three dimensional view of the first operation of the fitness equipment 700*a* of FIG. 8A. FIG. 8C is a three dimensional view of the second operation of the fitness equipment 700*a* of FIG. 8A. As shown in FIG. 7A, FIG. 7B, FIG. 7C, FIG. 8A, FIG. 8B and FIG. 8C, the fitness equipment 700*a* includes a body 200*a*, a rotational axis assembly 300, a flexible element 400, a reciprocating member 500*b*, a housing 800 and two leaning members 900.

According to the embodiment of FIG. 7A, the structure of the rotational axis assembly 300, the flexible element 400 and the reciprocating member 500*b* are the same as the structure of the rotational axis assembly 300, the flexible element 400 and reciprocating member 500*b* in the 2nd embodiment of FIG. 2A, and will not be described herein. According to the embodiment of FIG. 7A, the fitness equipment 700*a* further includes the body 200*a*, the housing 800 and the leaning members 900. The body 200*a* includes a first support 210*a*, a reciprocation connecting portion 232*a*, a supporting rod 240 and a storing base 250. The first support 210*a* is connected between the central axis 320 and the reciprocation connecting portion 232*a*. An end of the supporting rod 240 is connected to the first support 210*a*. The reciprocation connecting portion 232*a* is disposed on the supporting rod 240 and is close to the first support 210*a*. The other end of the supporting rod 240 is connected to the storing base 250, and the supporting rod 240 is passed through the reciprocating member 500*b* (which is the torsion spring) and the storing base 250. The torsion spring is connected between the reciprocation connecting portion 232*a* and the storing base 250 so as to provide a restoring force. Furthermore, the furling base 310 is pivotally connected to the central axis 320. The two ends of the central axis 320 are connected to the two leaning members 900, respectively, and the central axis 320 is simultaneously actuated with the two leaning members 900. The flexible element 400 is disposed on the storing base 250 and is corresponded to the furling base 310; that is, the flexible element 400 is connected between the storing base 250 and the furling base 310. Furthermore, the housing 800 is a hollow cylinder and is connected to the furling base 310 of the rotational axis assembly 300. The central axis 320 is passed through the housing 800 and is separated from the housing 800 in a space without contact. The leaning members 900 are for against the body of the user. Moreover, in FIG. 7B and FIG. 8B, when the rotational axis assembly 300, the flexible element 400, and the torsion spring are viewed from the negative X-axis direction, it is understood that the flexible element 400 is furled around the furling base 310 in the clockwise direction from the lower side of the rotational axis assembly 300. When the rotating direction R is the clockwise direction and the force F1 is greater than the restoring force F2, the torsion spring is rotated in the counterclockwise direction. In FIG. 7C and FIG. 8C, when the rotational axis assembly 300, the flexible element 400, and the torsion spring are viewed from the negative X-axis direction, it is understood that the flexible element 400 is furled around the furling base 310 in the counterclockwise direction from the upper side of the rotational axis assembly 300. When the rotating direction R is the counterclockwise direction and the force F1 is greater than the restoring force F2, the torsion spring is rotated in the counterclockwise direction. Therefore, the fitness equipment 700*a* of the embodiment in FIG. 7A with the reciprocating member 500*b* being the torsion spring can perform the elasticity in both of the clockwise rotating direction and the counterclockwise rotating direction by cooperating with the rotational axis assembly 300, so that the restoring force F2 opposite to the force F1 can be generated. Thus, it is favorable for providing the fitness equipment 700*a* can have characteristics of simple structure and low cost, and can also provide reciprocating operation.

Figure 9A:
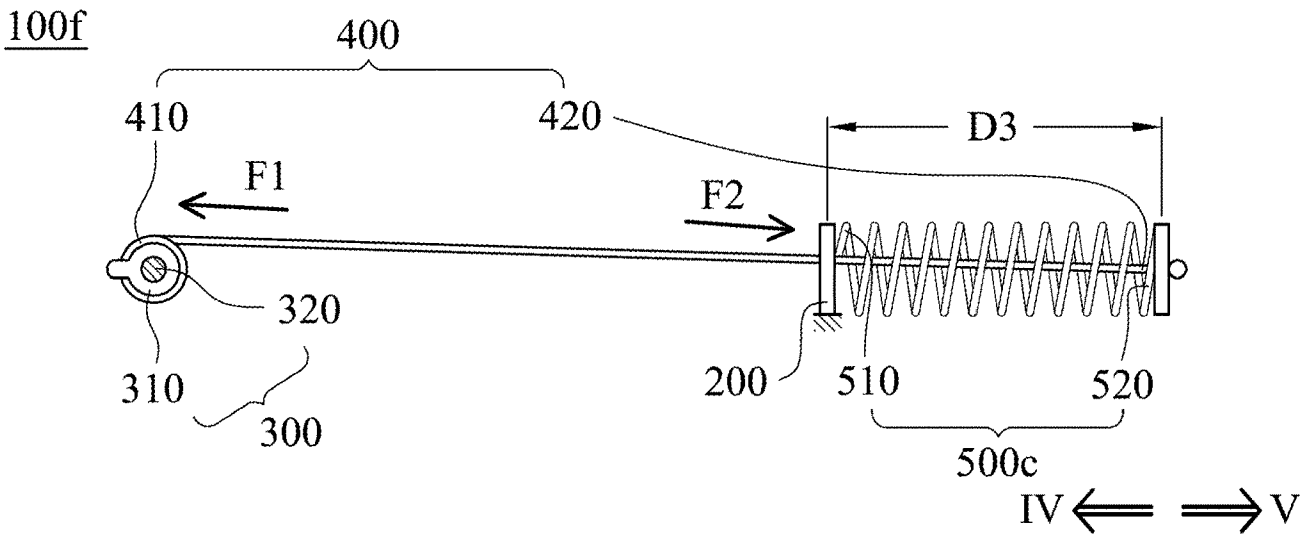
FIG. 9A is a schematic view of the two-way reciprocating structure according to the 6th embodiment of the present disclosure.
Figure 9B:
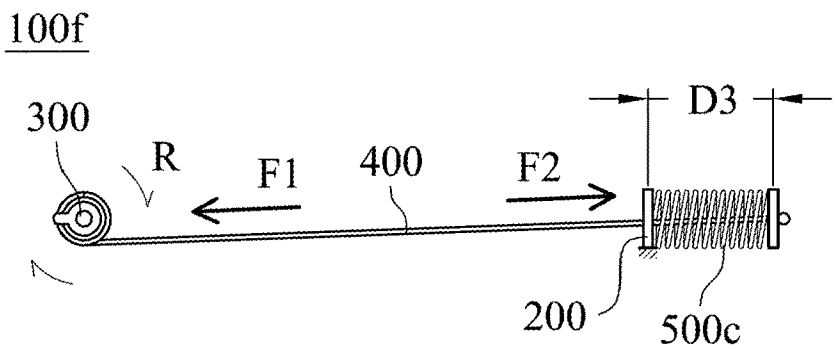
FIG. 9B is a schematic view of the rotational axis assembly rotating in a clockwise direction of FIG. 9A.
Figure 9C:
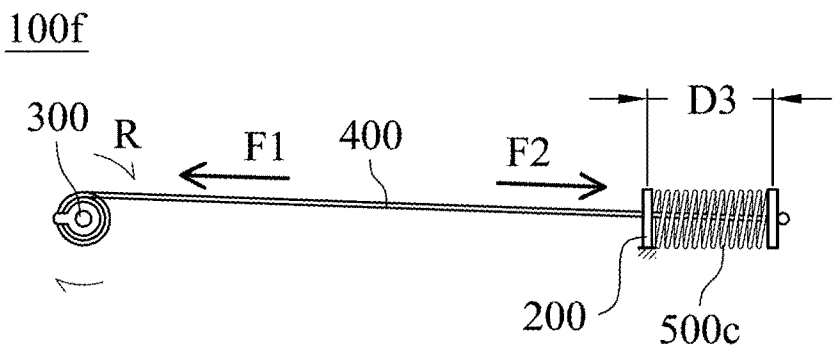
FIG. 9C is a schematic view of the rotational axis assembly rotating in a counterclockwise direction of FIG. 9A.

Please refer to FIG. 3A, FIG. 9A, FIG. 9B and FIG. 9C together. FIG. 9A is a schematic view of the two-way reciprocating structure 100*f* according to the 6th embodiment of the present disclosure. FIG. 9B is a schematic view of the rotational axis assembly 300 rotating in a clockwise direction of FIG. 9A. FIG. 9C is a schematic view of the rotational axis assembly 300 rotating in a counterclockwise direction of FIG. 9A. As shown in FIG. 9A, FIG. 9B and FIG. 9C, the two-way reciprocating structure 100*f* includes a body 200, a rotational axis assembly 300, a flexible element 400 and a reciprocating member 500*c*.

According to the 6th embodiment of FIG. 9A, the structure of the body 200, the rotational axis assembly 300, the flexible element 400 and the reciprocating member 500*c* are the same as the structure of the body 200, the rotational axis assembly 300, the flexible element 400 and the reciprocating member 500*c* of the 3rd embodiment in FIG. 3A, and will not be described herein. The differences between the two-way reciprocating structure 100*c* of the 3rd embodiment and the two-way reciprocating structure 100*f* of the 6th embodiment are that the two-way reciprocating structure 100*f* of the 6th embodiment does not include the pulley and the angle between the arranging direction of the reciprocating member 500*c* in the 3rd embodiment and the arranging direction of the reciprocating member 500*c* in the 6th embodiment is 180 degrees. When the force F1 is smaller than the restoring force F2, the second reciprocating end 520 and the second flexible end 420 are displaced along a restoring direction V. When the force F1 is greater than the restoring force F2, the second reciprocating end 520 and the second flexible end 420 are displaced along an anti-restoring direction IV. When the force F1 is equal to the restoring force F2, the second reciprocating end 520 and the second flexible end 420 are stationary. Moreover, in FIG. 9B, the flexible element 400 is furled around the furling base 310 in the clockwise direction from the lower side of the rotational axis assembly 300. When the rotating direction R is the clockwise direction and the force F1 is greater than the restoring force F2, the second reciprocating end 520 is approached to the first reciprocating end 510 so as to shorten the length of the compression spring D3. In FIG. 9C, the flexible element 400 is furled around the furling base 310 in the counterclockwise direction from the upper side of the rotational axis assembly 300. When the rotating direction R is the counterclockwise direction and the force F1 is greater than the restoring force F2, the second reciprocating end 520 is approached to the first reciprocating end 510 so as to shorten the length of the compression spring D3. Therefore, in the two-way reciprocating structure 100*f* of the 6th embodiment, the reciprocating member 500*c* being the compression spring can perform the elasticity in both of the clockwise rotating direction and the counterclockwise rotating direction by cooperating with the rotational axis assembly 300, so that the restoring force F2 opposite to the force F1 can be generated. Thus, it is favorable for providing the two-way reciprocating structure 100*f* can have characteristics of simple structure and low cost, and can also provide reciprocating operation.

Figure 10A:
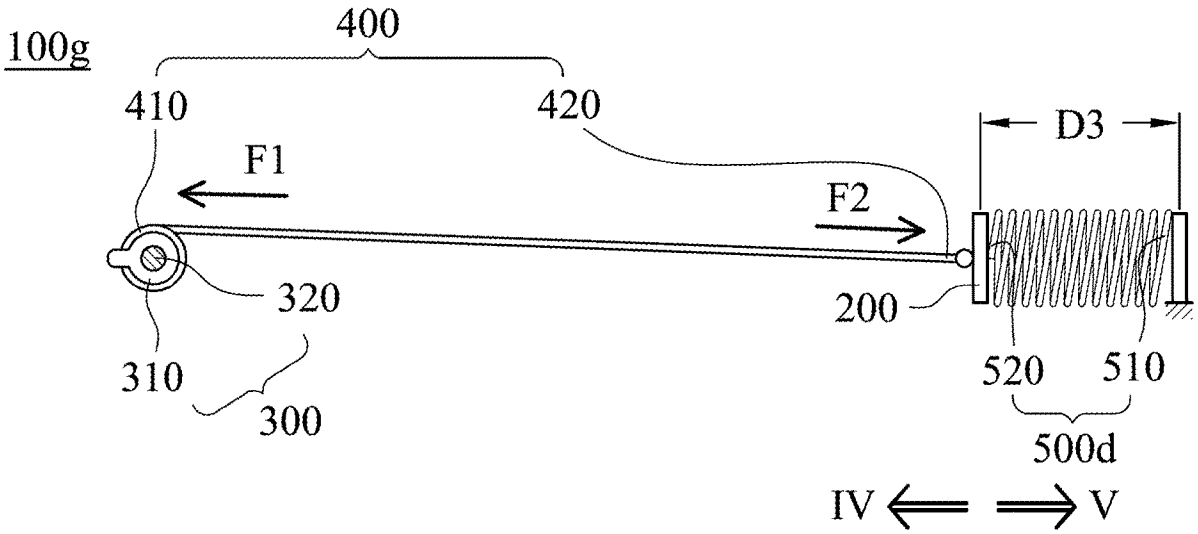
FIG. 10A is a schematic view of the two-way reciprocating structure according to the 7th embodiment of the present disclosure.
Figure 10C:
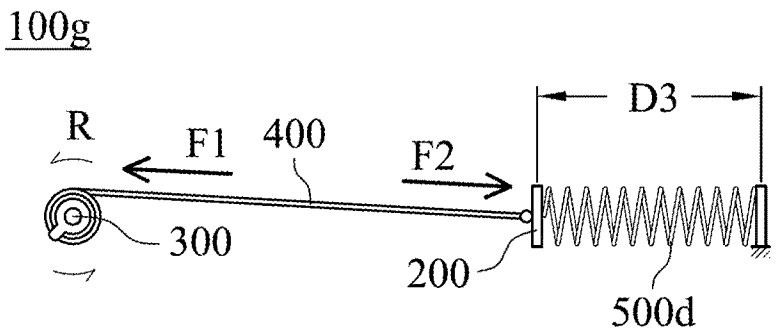
FIG. 10C is a schematic view of the rotational axis assembly rotating in a counterclockwise direction of FIG. 10A.
Figure 10B:
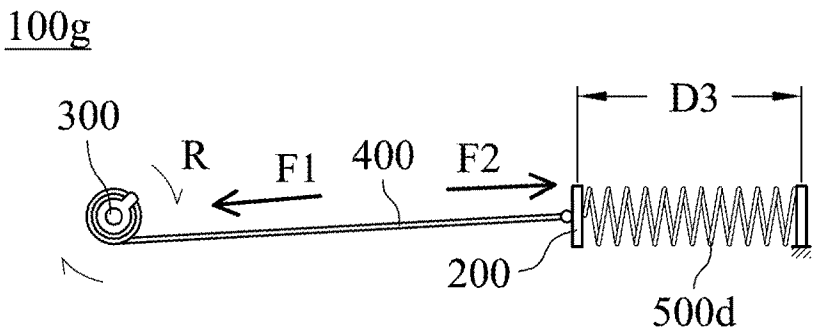
FIG. 10B is a schematic view of the rotational axis assembly rotating in a clockwise direction of FIG. 10A.

Please refer to FIG. 4A, FIG. 10A, FIG. 10B and FIG. 10C together. FIG. 10A is a schematic view of the two-way reciprocating 100*g* structure according to the 7th embodiment of the present disclosure. FIG. 10B is a schematic view of the rotational axis assembly 300 rotating in a clockwise direction of FIG. 10A. FIG. 10C is a schematic view of the rotational axis assembly 300 rotating in a counterclockwise direction of FIG. 10A. As shown in FIG. 10A, FIG. 10B and FIG. 10C, the two-way reciprocating structure 100*g* includes a body 200, a rotational axis assembly 300, a flexible element 400 and a reciprocating member 500*d*.

According to the 7th embodiment of FIG. 10A, the structure of the body 200, the rotational axis assembly 300, the flexible element 400 and the reciprocating member 500*d* are the same as the structure of the body 200, the rotational axis assembly 300, the flexible element 400 and the reciprocating member 500*d* of the 4th embodiment in FIG. 4A, and will not be described herein. The differences between the two-way reciprocating structure 100*d* of the 4th embodiment and the two-way reciprocating structure 100*g* of the 7th embodiment are that the two-way reciprocating structure 100*g* of the 7th embodiment does not include the pulley and the angle between the arranging direction of the reciprocating member 500*d* in the 4th embodiment and the arranging direction of the reciprocating member 500*d* in the 7th embodiment is 180 degrees. When the force F1 is smaller than the restoring force F2, the second reciprocating end 520 and the second flexible end 420 are displaced along a restoring direction V. When the force F1 is greater than the restoring force F2, the second reciprocating end 520 and the second flexible end 420 are displaced along an anti-restoring direction IV. When the force F1 is equal to the restoring force F2, the second reciprocating end 520 and the second flexible end 420 are stationary. Moreover, in FIG. 10B, the flexible element 400 is furled around the furling base 310 in the clockwise direction from the lower side of the rotational axis assembly 300. When the rotating direction R is the clockwise direction and the force F1 is greater than the restoring force F2, the second reciprocating end 520 is leaved from the first reciprocating end 510 so as to increase the length of the extension spring D3. In FIG. 10C, the flexible element 400 is furled around the furling base 310 in the counterclockwise direction from the upper side of the rotational axis assembly 300. When the rotating direction R is the counterclockwise direction and the force F1 is greater than the restoring force F2, the second reciprocating end 520 is leaved from the first reciprocating end 510 so as to increase the length of the extension spring D3. Therefore, in the two-way reciprocating structure 100*g* of the 7th embodiment, the reciprocating member 500*d* being the extension spring can perform the elasticity in both of the clockwise rotating direction and the counterclockwise rotating direction on by cooperating with the rotational axis assembly 300, so that the restoring force F2 opposite to the force F1 can be generated. Moreover, due to the simple structure of the two-way reciprocating structure 100*g*, it can be widely applied to various types of the sport equipments or the fitness equipments which need reciprocating operation.

Figure 11A:
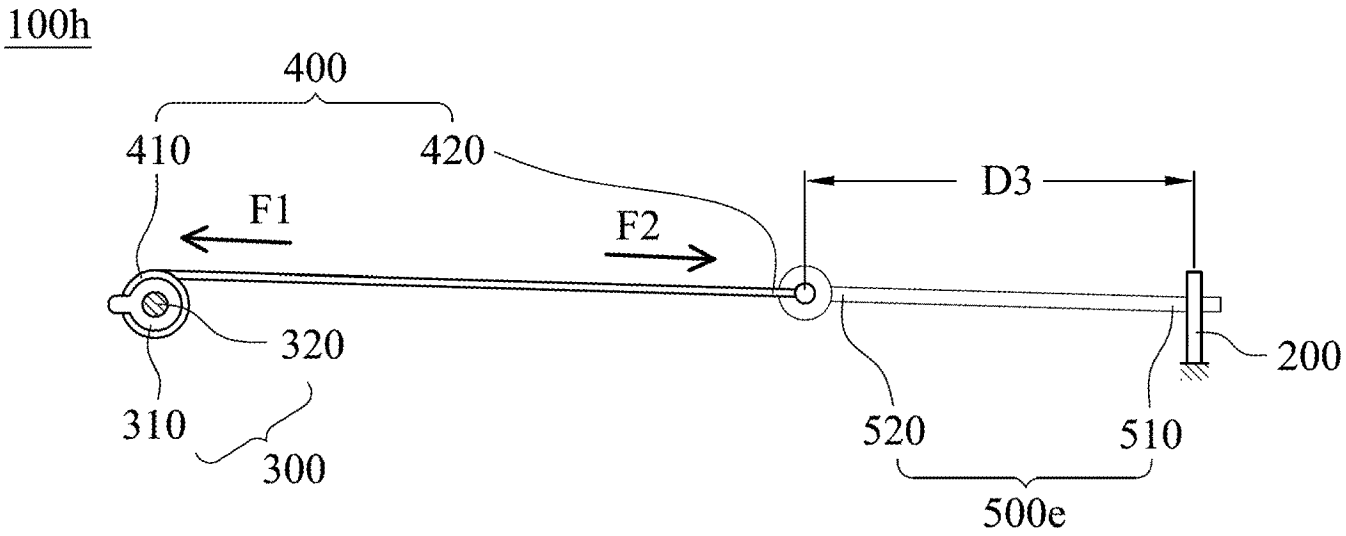
FIG. 11A is a schematic view of the two-way reciprocating structure according to the 8th embodiment of the present disclosure.
Figure 11B:
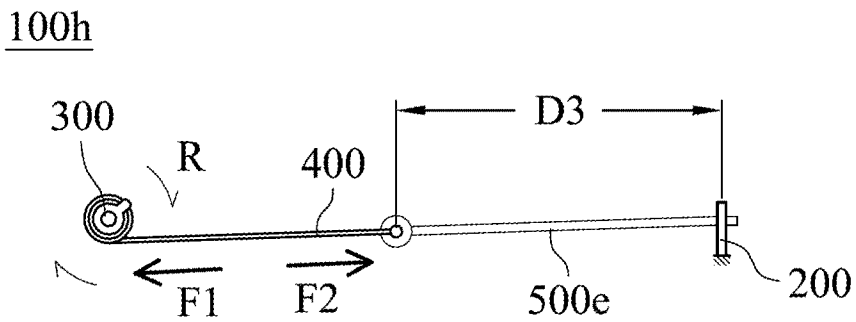
FIG. 11B is a schematic view of the rotational axis assembly rotating in a clockwise direction of FIG. 11A.
Figure 11C:
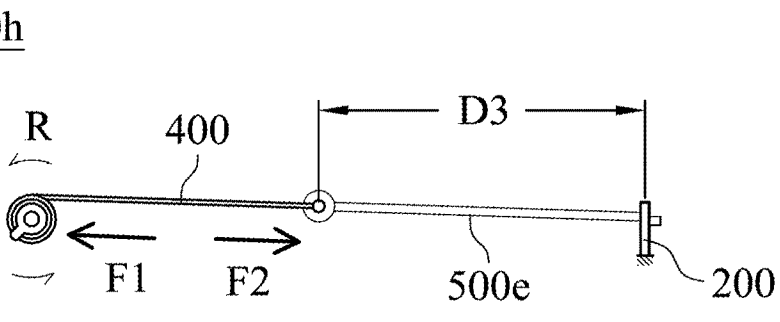
FIG. 11C is a schematic view of the rotational axis assembly rotating in a counterclockwise direction of FIG. 11A.

Please refer to FIG. 5A, FIG. 11A, FIG. 11B and FIG. 11C together. FIG. 11A is a schematic view of the two-way reciprocating structure 100*h* according to the 8th embodiment of the present disclosure. FIG. 11B is a schematic view of the rotational axis assembly 300 rotating in a clockwise direction of FIG. 11A. FIG. 11C is a schematic view of the rotational axis assembly 300 rotating in a counterclockwise direction of FIG. 11A. As shown in FIG. 11A, FIG. 11B and FIG. 11C, the two-way reciprocating structure 100*h* includes a body 200, a rotational axis assembly 300, a flexible element 400 and a reciprocating member 500*e*.

According to the 8th embodiment of FIG. 11A, the structure of the body 200, the rotational axis assembly 300, the flexible element 400 and the reciprocating member 500*e* are the same as the structure of the body 200, the rotational axis assembly 300, the flexible element 400 and the reciprocating member 500*e* of the 5th embodiment in FIG. 5A, and will not be described herein. The differences between the two-way reciprocating structure 100*e* of the 5th embodiment and the two-way reciprocating structure 100*h* of the 8th embodiment are that the two-way reciprocating structure 100*h* of the 8th embodiment does not include the pulley and the angle between the arranging direction of the reciprocating member 500*e* in the 5th embodiment and the arranging direction of the reciprocating member 500*e* in the 8th embodiment is 180 degrees. Moreover, in FIG. 11B, the flexible element 400 is furled around the furling base 310 in the clockwise direction from the lower side of the rotational axis assembly 300. When the rotating direction R is the clockwise direction and the force F1 is greater than the restoring force F2, the second reciprocating end 520 is leaved from the first reciprocating end 510 so as to increase the length of the rope D3. When the rotating direction R is the counterclockwise direction and the force F1 is greater than the restoring force F2, the second reciprocating end 520 is leaved from the first reciprocating end 510 so as to increase the length of the rope D3. Therefore, in the two-way reciprocating structure 100*h* of the 8th embodiment, the reciprocating member 500*e* being the rope can perform the elasticity in both of the clockwise rotating direction and the counterclockwise rotating direction by cooperating with the rotational axis assembly 300, so that the restoring force F2 opposite to the force F1 can be generated. Thus, it is favorable for providing the two-way reciprocating structure 100*h* can have characteristics of simple structure and low cost, and can also provide reciprocating operation.

Figure 12A:
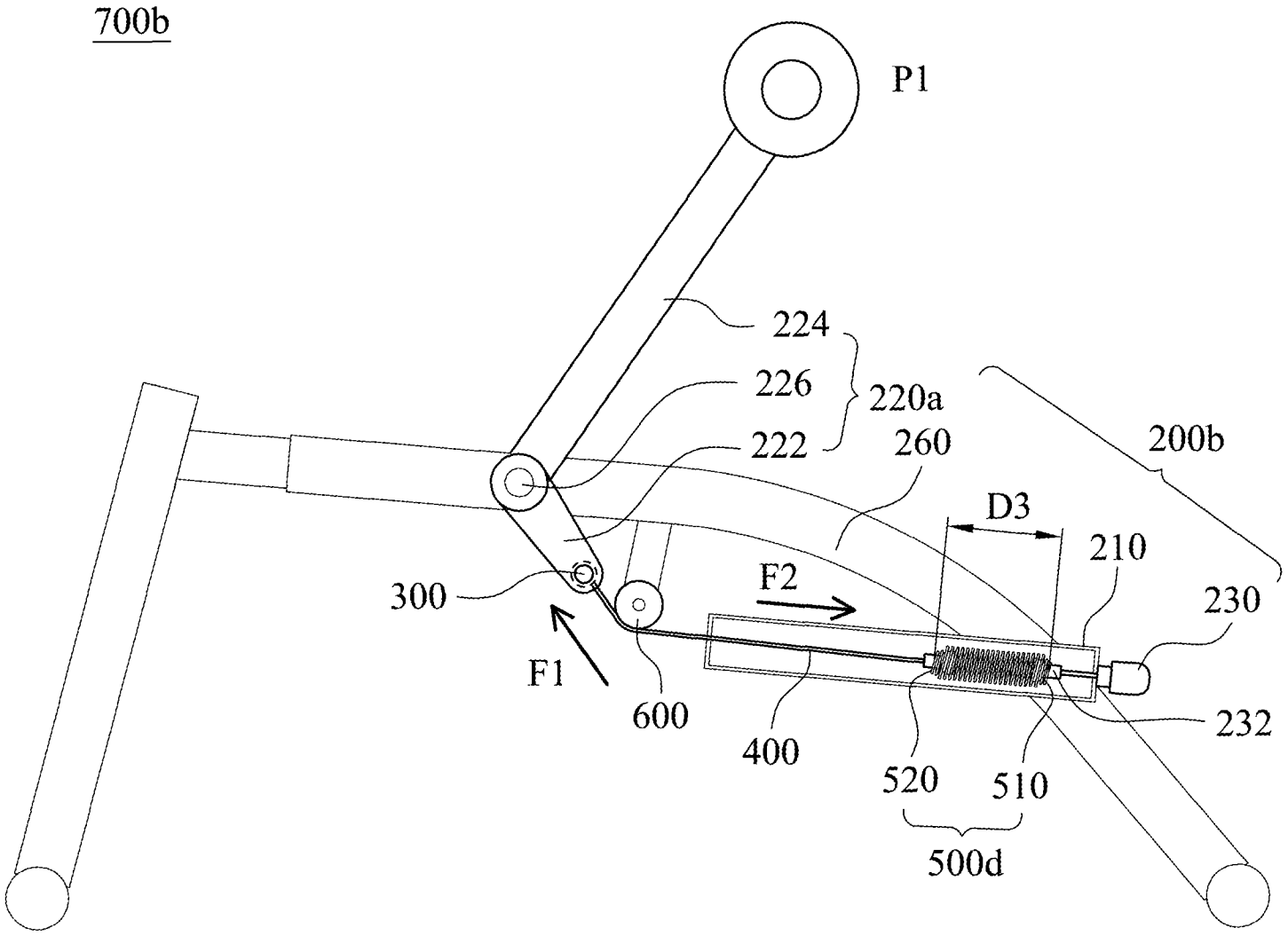
FIG. 12A is a schematic view of the two-way reciprocating structure applied to another fitness equipment of FIG. 4A.
Figure 12B:
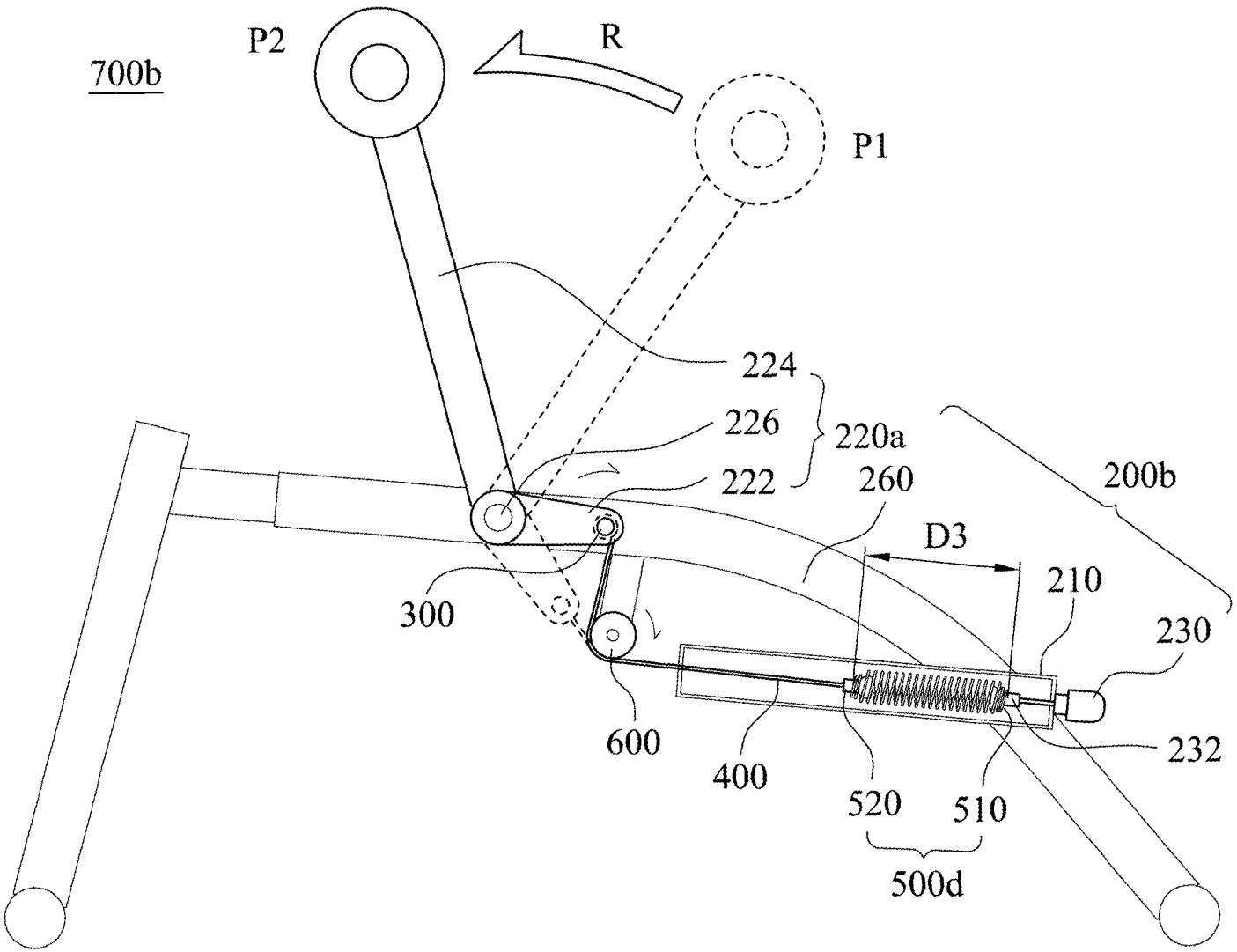
FIG. 12B is a schematic view of the first operation of the fitness equipment of FIG. 12A.
Figure 12C:
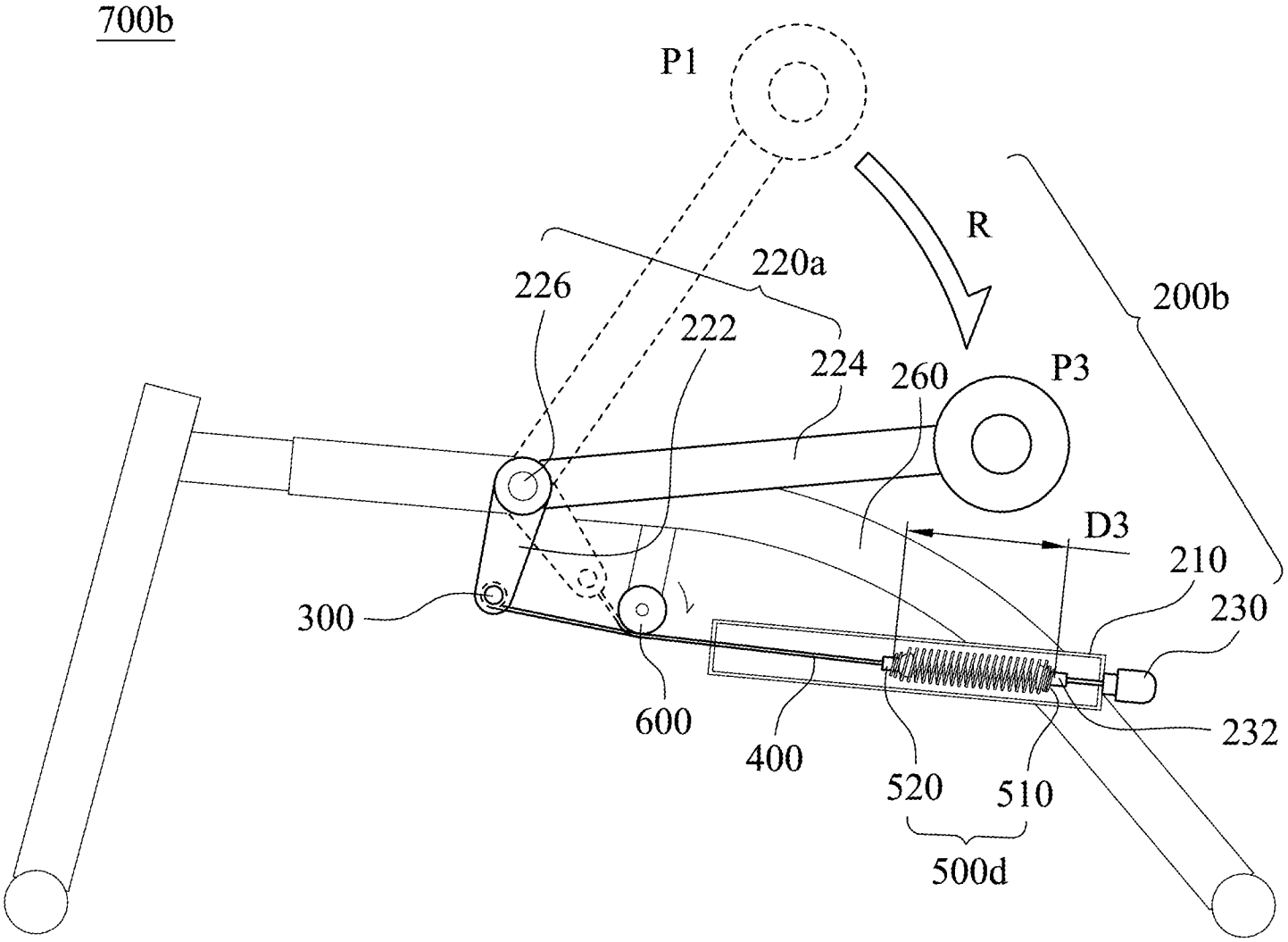
FIG. 12C is a schematic view of the second operation of the fitness equipment of FIG. 12A.

Please refer to FIG. 4A, FIG. 12A, FIG. 12B and FIG. 12C together. FIG. 12A is a schematic view of the two-way reciprocating structure 100*d* applied to another fitness equipment 700*b* of FIG. 4A. FIG. 12B is a schematic view of the first operation of the fitness equipment 700*b* of FIG. 12A. FIG. 12C is a schematic view of the second operation of the fitness equipment 700*b* of FIG. 12A. As shown in FIG. 12A, FIG. 12B and FIG. 12C, the fitness equipment 700*b* includes a body 200*b*, a rotational axis assembly 300, a flexible element 400, a reciprocating member 500*d* and a pulley 600.

According to the embodiment of FIG. 12A, the structure of the rotational axis assembly 300, the flexible element 400, the reciprocating member 500*d* and the pulley 600 are the same as the structure of the rotational axis assembly 300, the flexible element 400, reciprocating member 500*d* and the pulley 600 of the 4th embodiment in FIG. 4A, and will not be described herein. According to the embodiment of FIG. 12A, the body 200*b* of the fitness equipment 700*b* includes a first support 210, a second support 220*a*, an adjusting module 230 and a third support 260, wherein the first support 210 and the second support 220*a* are connected to the third support 260. The second support 220*a* includes a lower support 222, an upper support 224 and a pivoting portion 226, and the second support 220*a* is pivotally connected to the third support 260 by the pivoting portion 226. An end of the lower support 222 and the upper support 224 are connected to the pivoting portion 226, and the rotational axis assembly 300 is disposed at the other end of the lower support 222 and connected to the flexible element 400. Moreover, the adjusting module 230 is disposed on the first support 210 and includes a reciprocation connecting portion 232. The second reciprocating end 520 of the reciprocating member 500*d* (which is the extension spring) is connected to the reciprocation connecting portion 232. The adjusting module 230 can adjust the position of the reciprocation connecting portion 232; that is, the position of the second reciprocating end 520 can be adjusted. Furthermore, in FIG. 12A, the second support 220*a* is in a stationary state without any external force, at the same time, the second support 220*a* is at the first position P1. In FIG. 12B, the second support 220*a* is rotated in the counterclockwise direction by an external force which is moved to the second position P2, at the same time, the flexible element 400 is furled around the furling base 310 in the counterclockwise direction from the upper side of the rotational axis assembly 300. When the rotating direction R is the counterclockwise direction and the force F1 is greater than the restoring force F2, the pulley 600 is rotated in the clockwise direction, and the second reciprocating end 520 is leaved from the first reciprocating end 510 so as to increase the length of the extension spring D3. When the force F1 is smaller than the restoring force F2, the second support 220*a* is return from the second position P2 to the first position P1 in the clockwise direction. Furthermore, in FIG. 12C, the second support 220*a* is rotated in the clockwise direction by the external force to move to the third position P3, at the same time, the flexible element 400 is furled around the furling base 310 in the clockwise direction from the lower side of the rotational axis assembly 300. When the rotating direction R is the clockwise direction and the force F1 is greater than the restoring force F2, the pulley 600 is rotated in the clockwise direction, and the second reciprocating end 520 is leaved from the first reciprocating end 510 so as to increase the length of the extension spring D3. When the force F1 is smaller than the restoring force F2, the second support 220*a* is return from the third position P3 to the first position P1 in the counterclockwise direction. It should be mentioned that the extension spring (which is the reciprocating member 500*d*) of the embodiment of FIG. 12A can be replaced by the scroll spring, the torsion spring, the compression spring or the rope, and the same reciprocating action can be achieved. Therefore, the fitness equipment 700*b* of the embodiment in FIG. 12A, the reciprocating member 500*d* being the extension spring can perform the elasticity in both of the clockwise rotating direction and the counterclockwise rotating direction by cooperating with the rotational axis assembly 300, so that the restoring force F2 opposite to the force F1 can be generated and the function of reciprocating motion can be provided. Thus, due to the simple structure of the fitness equipment 700*b*, it can be widely applied to various types of sport equipments or the fitness equipments which need reciprocating operation.

As the above embodiments, the present invention has the following advantages:

First, the reciprocating member can perform the elasticity in both of the clockwise rotating direction and the counterclockwise rotating direction by cooperating with the rotational axis assembly, so that the restoring force opposite to the force can be generated, and can also provide reciprocating operation.

Second, due to the simple structure of the present disclosure can be widely applied to various types of the sport equipments or the fitness equipments which need reciprocating operation.

Although the present disclosure has been described in considerable detail with reference to certain embodiments thereof, other embodiments are possible. Therefore, the spirit and scope of the appended claims should not be limited to the description of the embodiments contained herein.

It is apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A two-way reciprocating structure, comprising:

a body;

a rotational axis assembly disposed on the body;

a flexible element having a first flexible end and a second flexible end, the first flexible end connected to the rotational axis assembly, wherein the rotational axis assembly is rotated by a force along a rotating direction to wind the flexible element around the rotational axis assembly, and the rotating direction is a clockwise direction or a counterclockwise direction;

a reciprocating member having a first reciprocating end and a second reciprocating end, the first reciprocating end disposed on the body, and the second reciprocating end connected to the second flexible end and simultaneously displaced with the second flexible end, wherein the rotational axis assembly is restored via a restoring force relative to the force provided by the reciprocating member; and a pulley disposed on the body and rotationally connected to the flexible element, wherein a number of the pulley is one, and the pulley is surrounded by the flexible element and simultaneously actuated with the rotational axis assembly, the flexible element and the second reciprocating end.

2. The two-way reciprocating structure of claim 1, wherein the reciprocating member is a scroll spring, a torsion spring, a compression spring, an extension spring or a rope.

3. The two-way reciprocating structure of claim 1, wherein when the force is smaller than the restoring force, the second reciprocating end and the second flexible end are displaced along a restoring direction; and when the force is greater than the restoring force, the second reciprocating end and the second flexible end are displaced along an anti-restoring direction.

4. The two-way reciprocating structure of claim 1, wherein the flexible element comprises a nylon rope, a ribbon or a steel rope.

5. The two-way reciprocating structure of claim 4, wherein:

the body comprises an axis connecting portion and a reciprocation connecting portion;

the reciprocating member is a scroll spring connected between the reciprocation connecting portion and the second flexible end; and the rotational axis assembly comprises a furling base and a central axis, the furling base is disposed around the central axis and the flexible element is furled around the furling base, and the central axis is pivotally connected to the axis connecting portion.

6. The two-way reciprocating structure of claim 5, wherein:

when the rotating direction is the clockwise direction and the force is greater than the restoring force, the scroll spring is rotated in the counterclockwise direction; and when the rotating direction is the counterclockwise direction and the force is greater than the restoring force, the scroll spring is rotated in the counterclockwise direction.

7. The two-way reciprocating structure of claim 4, wherein:

the body comprises an axis connecting portion and a reciprocation connecting portion;

the reciprocating member is a torsion spring connected between the reciprocation connecting portion and the second flexible end; and the rotational axis assembly comprises a furling base and a central axis, the furling base is disposed around the central axis and the flexible element is furled around the furling base, and the central axis is pivotally connected to the axis connecting portion.

8. The two-way reciprocating structure of claim 7, wherein:

when the rotating direction is the clockwise direction and the force is greater than the restoring force, the torsion spring is rotated in the counterclockwise direction; and when the rotating direction is the counterclockwise direction and the force is greater than the restoring force, the torsion spring is rotated in the counterclockwise direction.

9. The two-way reciprocating structure of claim 4:

wherein the body comprises an axis connecting portion and a reciprocation connecting portion;

wherein the reciprocating member is a compression spring connected between the reciprocation connecting portion and the second flexible end, and a distance between the first reciprocating end and the pulley is smaller than a distance between the second reciprocating end and the pulley; and wherein the rotational axis assembly comprises a furling base and a central axis, the furling base is disposed around the central axis and the flexible element is furled around the furling base, and the central axis is pivotally connected to the axis connecting portion.

10. The two-way reciprocating structure of claim 9, wherein:

when the rotating direction is the clockwise direction and the force is greater than the restoring force, the pulley is rotated in the counterclockwise direction, and the second reciprocating end is approached to the first reciprocating end so as to shorten a length of the compression spring; and when the rotating direction is the counterclockwise direction and the force is greater than the restoring force, the pulley is rotated in the counterclockwise direction, and the second reciprocating end is approached to the first reciprocating end so as to shorten the length of the compression spring.

11. The two-way reciprocating structure of claim 4, wherein the body comprises an axis connecting portion and a reciprocation connecting portion;

wherein the reciprocating member is an extension spring connected between the reciprocation connecting portion and the second flexible end, and a distance between the first reciprocating end and the pulley is greater than a distance between the second reciprocating end and the pulley; and wherein the rotational axis assembly comprises a furling base and a central axis, the furling base is disposed around the central axis and the flexible element is furled around the furling base, and the central axis is pivotally connected to the axis connecting portion.

12. The two-way reciprocating structure of claim 11, wherein:

when the rotating direction is the clockwise direction and the force is greater than the restoring force, the pulley is rotated in the counterclockwise direction, and the second reciprocating end is leaved from the first reciprocating end so as to increase a length of the extension spring; and when the rotating direction is the counterclockwise direction and the force is greater than the restoring force, the pulley is rotated in the counterclockwise direction, and the second reciprocating end is leaved from the first reciprocating end so as to increase the length of the extension spring.

13. The two-way reciprocating structure of claim 4:

wherein the body comprises an axis connecting portion and a reciprocation connecting portion;

wherein the reciprocating member is a rope connected between the reciprocation connecting portion and the second flexible end, and a distance between the first reciprocating end and the pulley is greater than a distance between the second reciprocating end and the pulley; and wherein the rotational axis assembly comprises a furling base and a central axis, the furling base is disposed around the central axis and the flexible element is furled around the furling base, and the central axis is pivotally connected to the axis connecting portion.

14. The two-way reciprocating structure of claim 13, wherein:

when the rotating direction is the clockwise direction and the force is greater than the restoring force, the pulley is rotated in the counterclockwise direction, and the second reciprocating end is leaved from the first reciprocating end so as to increase a length of the rope; and when the rotating direction is the counterclockwise direction and the force is greater than the restoring force, the pulley is rotated in the counterclockwise direction, and the second reciprocating end is leaved from the first reciprocating end so as to increase the length of the rope.

15. The two-way reciprocating structure of claim 4, wherein:

the body comprises an axis connecting portion and a reciprocation connecting portion;

the reciprocating member is a compression spring connected between the reciprocation connecting portion and the second flexible end; and the rotational axis assembly comprises a furling base and a central axis, the furling base is disposed around the central axis and the flexible element is furled around the furling base, and the central axis is pivotally connected to the axis connecting portion;

when the rotating direction is the clockwise direction and the force is greater than the restoring force, the second reciprocating end is approached to the first reciprocating end so as to shorten a length of the compression spring; and when the rotating direction is the counterclockwise direction and the force is greater than the restoring force, the second reciprocating end is approached to the first reciprocating end so as to shorten the length of the compression spring.

16. The two-way reciprocating structure of claim 4, wherein:

the body comprises an axis connecting portion and a reciprocation connecting portion;

the reciprocating member is an extension spring connected between the reciprocation connecting portion and the second flexible end; and the rotational axis assembly comprises a furling base and a central axis, the furling base is disposed around the central axis and the flexible element is furled around the furling base, and the central axis is pivotally connected to the axis connecting portion;

when the rotating direction is the clockwise direction and the force is greater than the restoring force, the second reciprocating end is leaved from the first reciprocating end so as to increase a length of the extension spring; and when the rotating direction is the counterclockwise direction and the force is greater than the restoring force, the second reciprocating end is leaved from the first reciprocating end so as to increase the length of the extension spring.

17. The two-way reciprocating structure of claim 4, wherein:

the body comprises an axis connecting portion and a reciprocation connecting portion;

the reciprocating member is a rope connected between the reciprocation connecting portion and the second flexible end; and the rotational axis assembly comprises a furling base and a central axis, the furling base is disposed around the central axis and the flexible element is furled around the furling base, and the central axis is pivotally connected to the axis connecting portion;

when the rotating direction is the clockwise direction and the force is greater than the restoring force, the second reciprocating end is leaved from the first reciprocating end so as to increase a length of the rope; and when the rotating direction is the counterclockwise direction and the force is greater than the restoring force, the second reciprocating end is leaved from the first reciprocating end so as to increase the length of the rope.

* * * * *